US008498548B2

(12) United States Patent
Nishikawa et al.

(10) Patent No.: US 8,498,548 B2
(45) Date of Patent: Jul. 30, 2013

(54) BLOWER AND IMAGE FORMING APPARATUS

(75) Inventors: Satoru Nishikawa, Kanagawa (JP); Yuzo Ichikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 184 days.

(21) Appl. No.: 13/048,509

(22) Filed: Mar. 15, 2011

(65) Prior Publication Data

US 2012/0045243 A1 Feb. 23, 2012

(30) Foreign Application Priority Data

Aug. 23, 2010 (JP) ..... 2010-186489

(51) Int. Cl.
*G03G 21/20* (2006.01)

(52) U.S. Cl.
USPC ..... 399/92; 406/96; 5/423

(58) Field of Classification Search
USPC 15/401, 316.1; 399/92; 37/244, 225; 406/96; 5/423
See application file for complete search history.

(56) References Cited

U.S. PATENT DOCUMENTS 4,745,282 A * 5/1988 Tagawa et al. ..... 250/326

FOREIGN PATENT DOCUMENTS

JP 10-198128 A 7/1998
JP 10198128 A * 7/1998
JP 2001-235930 A 8/2001

OTHER PUBLICATIONS

Midwest Ducts, Residential and Light Commercial Products, May 2007, p. 12.*

* cited by examiner

*Primary Examiner* — Clayton E Laballe
*Assistant Examiner* — Jas Sanghera
(74) *Attorney, Agent, or Firm* — Sughrue Mion, PLLC

(57) ABSTRACT

A blower includes a fan; and an air duct having a passage formed therein, the air duct guiding the air and blowing the air onto the corona discharger, the air duct including an increasing-width portion in which a passage width gradually increases downstream in an air flow direction, a decreasing-height portion in which a passage height gradually decreases downstream in the air flow direction, an extension portion extending from a downstream end of the decreasing-height portion to a position near the corona discharger, a bent portion that is bent from a downstream end of the extension portion toward the corona discharger, an opening formed at a downstream end of the bent portion, and a plate-shaped member disposed in the passage at a position on an inner wall of any of the decreasing-height portion and the extension portion, the inner wall being on the corona discharger side.

8 Claims, 19 Drawing Sheets

BLOWER AND IMAGE FORMING APPARATUS

CROSS-REFERENCE TO RELATED APPLICATIONS

This application is based on and claims priority under 35 USC 119 from Japanese Patent Application No. 2010-186489 filed Aug. 23, 2010.

BACKGROUND (i) Technical Field

The present invention relates to a blower and an image forming apparatus.

(ii) Related Art

There are image forming apparatuses, such as printers, copiers, facsimiles, that form an image on a recording medium, such as a sheet, a cardboard, or an envelope, by using an electrophotographic method or the like. Some of these image forming apparatuses use a corona discharger, which includes linearly stretched discharge wires, for charging and discharging an object such as a photoconductor drum or a recording medium. Some of the image forming apparatuses that use such a corona discharger include a blower, and the blower blows air from a fan through a duct onto the discharge wires and other required positions in order to prevent non-uniform discharge, which may be caused due to smudges on the corona discharger or due to other reasons.

SUMMARY

According to an aspect of the invention, a blower includes a fan that blows air; and an air duct having a passage formed therein, the air duct guiding the air blown by the fan to a corona discharger and blowing the air onto the corona discharger, the corona discharger including a discharge wire stretched therein, the air duct including an increasing-width portion in which a passage width gradually increases downstream in an air flow direction, the passage width being a dimension of the passage along a direction in which the discharge wire is stretched, a decreasing-height portion in which a passage height gradually decreases downstream in the air flow direction, the passage height being a distance between a top and a bottom of the passage, the decreasing height portion being included in a region of the increasing-width portion or included in a region including the increasing-width portion, an extension portion extending from a downstream end of the decreasing-height portion to a position near the corona discharger, the passage height of the passage throughout the extension portion being the same as the passage height at the downstream end of the decreasing height portion, a bent portion that is bent from a downstream end of the extension portion toward the corona discharger so as to be connected to the corona discharger, an opening formed at a downstream end of the bent portion in the air flow direction, the opening having a width at least corresponding to an effective length of the discharge wire, and a plate-shaped member disposed in the passage at a position on an inner wall of any of the decreasing-height portion and the extension portion, the inner wall being on the corona discharger side, the plate-shaped member extending over the entire passage width.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the invention (hereinafter simply referred to as "exemplary embodiments") will be described with reference to the drawings.

First Exemplary Embodiment

Figure 1:
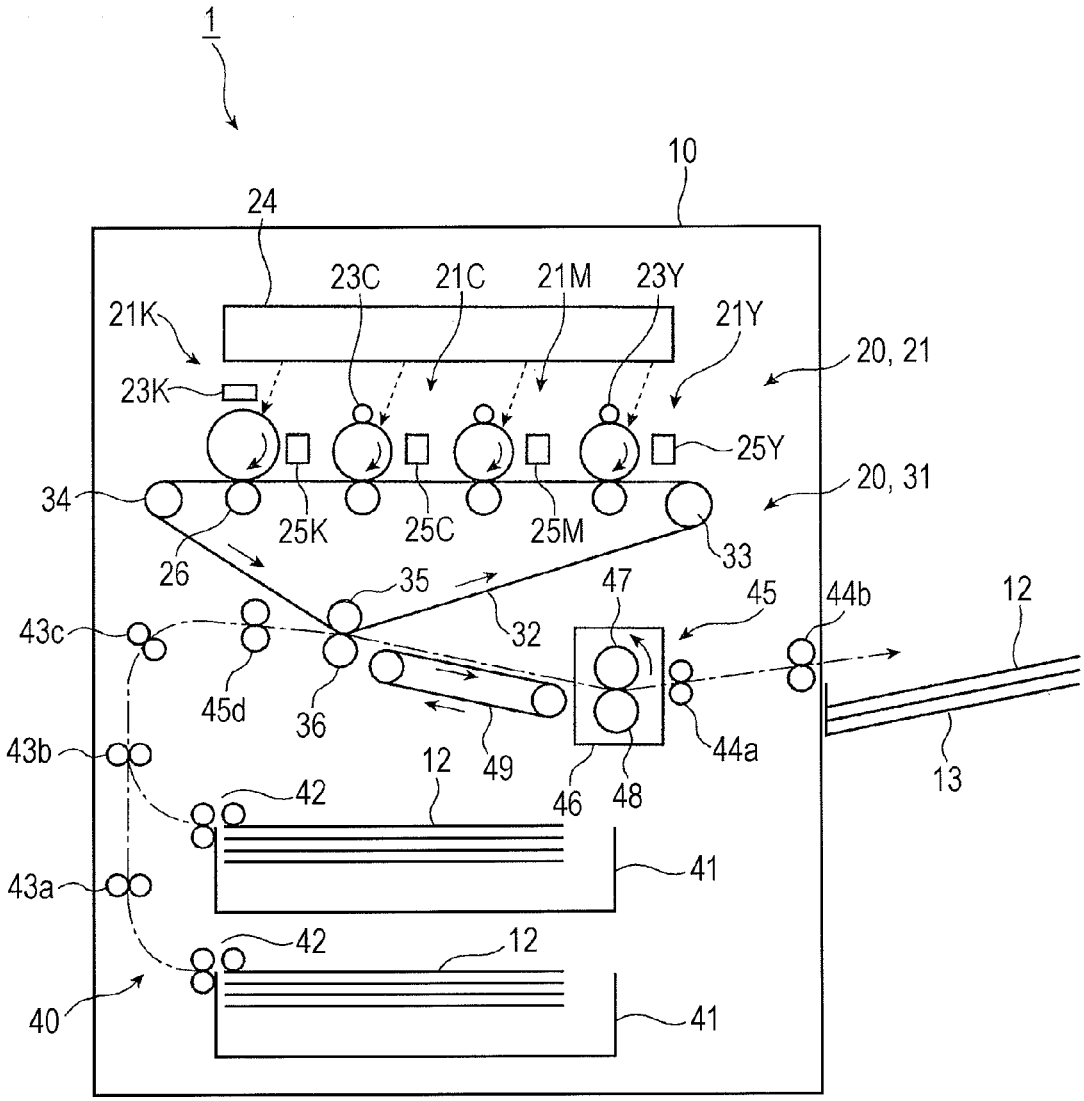
FIG. 1 is a schematic view of an image forming apparatus according to a first exemplary embodiment.
Figure 2:
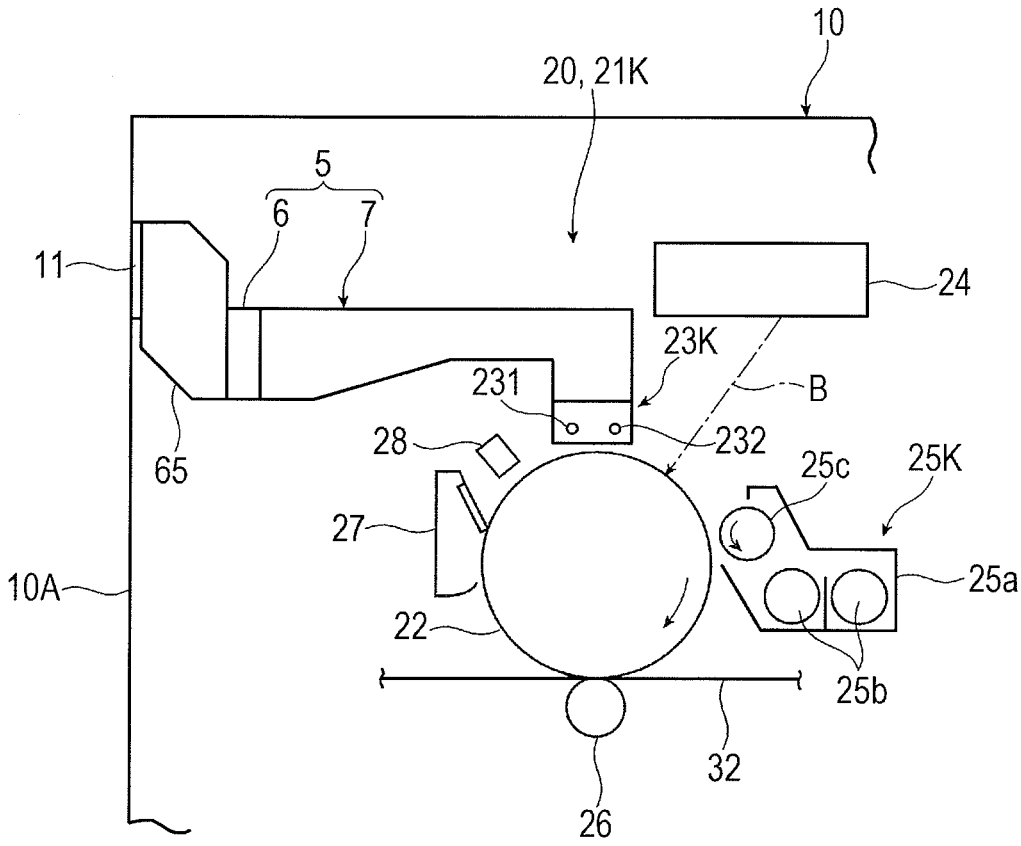
FIG. 2 is a partial schematic view of the image forming apparatus of FIG. 1, illustrating a blower and an image forming unit to which the blower is applied.
Figure 3:
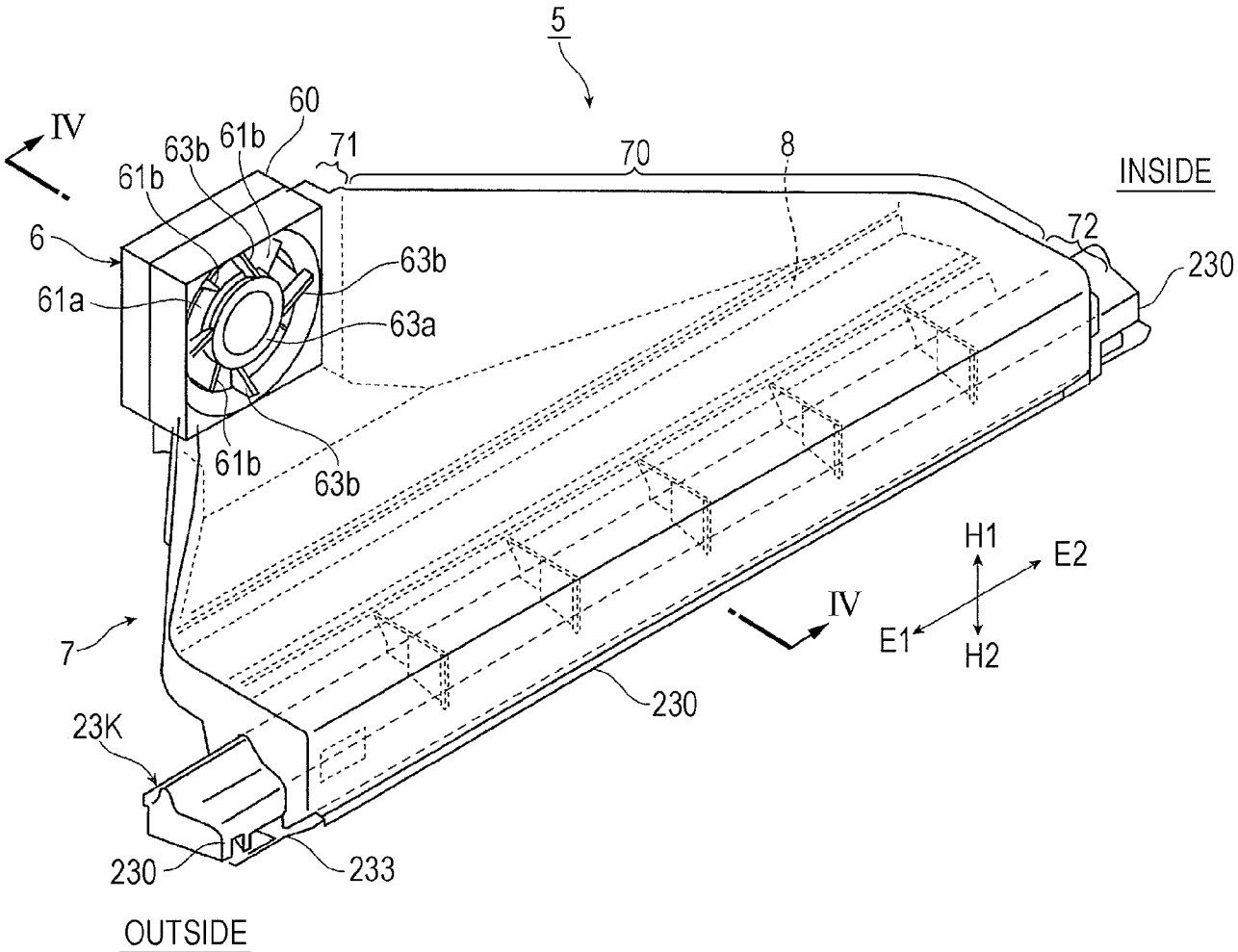
FIG. 3 is a partially transparent perspective view of a blower according to the first exemplary embodiment and a charging device to which the blower is applied.

FIGS. 1 to 3 illustrate an image forming apparatus 1 or a blower 5 according to a first exemplary embodiment. FIG. 1 is a schematic view of the image forming apparatus 1. FIG. 2 illustrates the blower 5 included in the image forming apparatus 1 and the vicinity of the blower 5. FIG. 3 illustrates the blower 5 and other components.

Referring to FIG. 1, the image forming apparatus 1 according to the first exemplary embodiment includes an image forming device 20, a sheet feeder 40, a fixing device 45, a control device (not shown), which are disposed in a housing 10 constituted by a supporting member, an outer cover, and the like. The image forming device 20 forms a toner image from toner (developer), and transfers the toner image to a recording sheet 12 (recording medium). The sheet feeder 40 contains the recording sheet 12 and feeds the recording sheet 12 to the image forming device 20. The fixing device 45 fixes the toner image, which has been transferred to the recording sheet 12, onto the recording sheet 12. The control device performs overall control of the operations of components of the image forming apparatus 1.

The image forming device 20 includes an image forming section 21 and an intermediate transfer section 31. The image forming section 21 forms a toner image by using a known electrophotographic method. The image forming section 21 receives the toner image formed by the intermediate transfer section 31 and transfers the toner image onto the recording sheet 12.

The image forming section 21 includes four image forming units 21Y, 21M, 21C, and 21K, which respectively form yellow (Y), magenta (M), cyan (C), and black (K) toner images. The image forming units 21Y, 21M, 21C, and 21K are arranged linearly and substantially horizontally in an upper space in the housing 10. Referring to FIG. 2 etc., each of the image forming units 21Y, 21M, 21C, and 21K includes a photoconductor drum 22 that is rotatable, a charging device 23 disposed near the photoconductor drum 22, an exposure device 24, a developing device 25, a first-transfer device 26, a cleaning device 27, and a static charge eliminator 28.

The photoconductor drum 22 includes a cylindrical base member and a photoconductive layer formed on the peripheral surface of the cylindrical base member. The cylindrical base member is rotatably supported, electroconductive, and grounded. The photoconductor drum 22 is rotated by a motor (not shown) in a required direction (indicated by an arrow) at a required speed. The cleaning device 27 includes a cleaning member and a recovery container. The cleaning member is an elastic plate or the like that contacts a peripheral surface of the photoconductor drum 22 after transfer has been finished. The recovery container holds toner and other adherents that have been removed by the cleaning member. The static charge eliminator 28 discharges the peripheral surface of the photoconductor drum 22 after transfer has been finished. For example, the static charge eliminator 28 is a static charge eliminating lamp that discharges the peripheral surface of the photoconductor drum 22 by exposing the peripheral surface to light.

The charging device 23 charges an effective image-forming area of the peripheral surface of the photoconductor drum 22 with respect to the axial direction of the photoconductor drum 22 to a required potential. As the charging device 23, a corona discharger 23K, which serves as a non-contact type charger, and charging units 23Y, 23M, and 23C, which are contact-type chargers, are used. Each of the charging units 23Y, 23M, and 23C applies a charging voltage, which is supplied by a power source (not shown), to a charging roller that rotates while being in contact with at least the effective image-forming area of the photoconductor drum 22. As the charging voltage, a DC voltage or a DC voltage on which an AC voltage is superimposed is applied to the charging roller.

The exposure device 24 irradiates the photoconductor drum 22 with a light beam B in accordance with image information that has been input to the image forming apparatus 1, thereby forming an electrostatic latent image. For example, a scanning exposure device, which includes a semiconductor laser and optical components such as a polygon mirror, or a non-scanning exposure device, which includes a light emitting diode and optical components, is used as the exposure device 24. The exposure device 24 may be provided independently to each of the image forming units 21Y, 21M, 21C, and 21K, or may be integrated with some or all of the image forming units 21Y, 21M, 21C, and 21K.

The developing device 25 supplies developer (toner), which has been charged with a required polarity that is suitable for the developing method, to a development region that faces the photoconductor drum 22 and develops an electrostatic latent image. For example, a two-component developing device is used as the developing device 25. The two-component developing device performs contact reversal development by using two-component developer, which includes nonmagnetic toner and magnetic carrier. FIG. 2 illustrates an apparatus body 25*a*, a developer agitating member 25*b*, and a cylindrical developing roller 25*c*. The apparatus body 25*a* has an opening, a developer container for holding two-component developer, etc. The developer agitating member 25*b* rotates in the developer container to agitate the two-component developer and triboelectrify the toner. Required magnetic poles are fixed and arranged in the developing roller 25*c* that rotates. The developing roller 25*c* holds toner and carrier in the developer container with a predetermined thickness and transports the toner and the carrier to the development region facing the photoconductor drum 22. A developing power supply (not shown) applies a developing voltage (developing bias) between the developing roller 25*c* and the photoconductor drum 22. A DC voltage on which an AC voltage is superimposed is used as the developing voltage.

The first-transfer device 26 transfers a toner image formed on the photoconductor drum 22 to the recording sheet 12. The first-transfer device 26 includes a transfer roller that rotates while being in contact with at least the charged region of the photoconductor drum 22 with respect to the axial direction. A power supply (not shown) applies a transfer voltage to the transfer roller. As the transfer voltage, a voltage having a polarity opposite to that of developer is used. In the exemplary embodiment, a positive DC voltage is applied as the transfer voltage, because the developer is negatively charged.

Referring to FIGS. 1 and 2, the intermediate transfer section 31 is disposed below the image forming device 20 (the image forming units 21Y, 21M, 21C, and 21K) in the housing 10. The intermediate transfer section 31 includes an intermediate transfer belt 32, supporting rollers 33 to 35, a second-transfer roller 36, and a belt cleaning device (not shown). The intermediate transfer belt 32 rotates in the direction indicated by an arrow while passing through a space between the photoconductor drum 22 and the first-transfer device 26 (first-transfer roller), which is at the first transfer position. The supporting rollers 33 to 35 rotatably support the inner surface of the intermediate transfer belt 32 in a desired state. The second-transfer roller 36 is in contact with the intermediate transfer belt 32, which is supported by the supporting roller 35, with a predetermined pressure, and thereby rotated. The belt cleaning device removes residual toner that is remaining on the intermediate transfer belt 32 after the intermediate transfer belt 32 has passed the second-transfer roller 36.

As the intermediate transfer belt 32, for example, an endless belt having a predetermined thickness and made of a synthetic resin material, such as a polyimide resin, a polyamide resin, or the like, in which resistance adjusting agent such as carbon is dispersed. The supporting roller 33 is a driving roller. A second transfer voltage, which is a DC voltage having a polarity the same as the polarity of toner, is applied to the supporting roller 35 at a required timing. Alternatively, a DC voltage having a polarity opposite to that of the toner may be applied to the second-transfer roller 36 as the second transfer voltage.

The sheet feeder 40 includes a sheet container 41 and a feeding mechanism 42. The sheet container 41 is removably attached to the housing 10, and holds a stack of the recording sheets 12 of desired types and in desired sizes. The feeding mechanism 42 feeds the recording sheet 12 one by one from the sheet container 41. After the recording sheets 12 have been fed by the feeding mechanism 42 from the sheet container 41 of the sheet feeder 40, each of the recording sheets 12 passes through a sheet feeding path to a second transport position in the image forming device 20. (The second transfer position is between the intermediate transfer belt 32 of the intermediate transfer section 31 and the second-transfer roller 36.) Pairs of transport rollers 43*a* to 43*d* and guide members are disposed along the sheet feeding path extending between the feeding mechanism 42 of the sheet feeder 40 and the second transfer position.

The fixing device 45 includes a rotary heating member 47 and a rotary pressing member 48 that are disposed in a housing 46. The rotary heating member 47, which has a roller-like or belt-like shape, rotates in a direction indicated by an arrow while the surface temperature is maintained at a required level by a heating element. The rotary pressing member 48, which has a roller-like or belt-like shape, is rotated by the rotary heating member 47 by contacting the rotary heating member 47 substantially along the axial direction of the rotary heating member 47 with a required pressure. A sheet transporting device 49 is disposed between the second transfer position and the fixing device 45. The sheet transporting device 49 is a belt mechanism that transports the recording sheet 12 to the fixing device 45 after the second transfer has been finished. An output tray 13 is attached to a side surface of the housing 10 near the fixing device 45 so as to protrude from the housing 10. The output tray 13 holds the recording sheet 12 on which an image has been formed and which has been output from the housing 10. A sheet output path is formed between the fixing device 45 and the output tray 13 (sheet output slit). The sheet output path includes pairs of sheet transport rollers 44*a* and 44*b* and guide members.

The control device includes a processor, a memory, a control circuit, an external storage device, and an input/output device. The control device controls the components of the image forming apparatus 1 in accordance with a control program stored in the memory or the external storage device. The control device is connected to, for example, a communication unit (input unit) to which image information is input, various detectors, an image processing unit that performs required image processing on the image information, and an operation input unit for setting and displaying the operation pattern and conditions for the image forming apparatus.

The image forming apparatus 1 forms an image basically as follows.

When control device receives a request for performing an image forming operation (for example, a request for printing a full-color image) from, for example, a communication unit or an operation input, the image forming section 21 (each of the image forming units 21Y, 21M, 21C, and 21K) of the image forming device 20 forms a toner image.

That is, in each the image forming units 21Y, 21M, 21C, and 21K, the charging device 23 charges the effective image-forming area, which is a part of the peripheral surface of the photoconductor drum 22 that rotates in the direction indicated by the arrow, to a required potential (charging potential). Then, the exposure device 24 irradiates the charged area of the peripheral surface of the photoconductor drum 22 with the light beam B that is emitted in accordance with each color component on the basis of image information (signal). Thus, an electrostatic latent image in each color, having a potential difference, is formed on the peripheral surface of the photoconductor drum 22. Next, in the image forming units 21Y, 21M, 21C, and 21K, the electrostatic latent images formed on the photoconductor drums 22 are (reversal) developed by using color toner charged with a negative polarity, which is supplied from the developing rollers 25*c* of the developing devices 25Y, 25M, 25C, and 25K, and toner images having four colors (Y, M, C, K) are independently formed on the photoconductor drums 22.

Next, at the first transfer positions of the image forming units 21Y, 21M, 21C, and 21K, which are between the image forming section 21 and the intermediate transfer section 31, the color toner images formed on the photoconductor drums 22 are sequentially first-transferred onto the intermediate transfer belt 32 of the intermediate transfer section 31 due to the transfer electric field formed by the first-transfer device 26. The cleaning device 27 removes adherents that remain on the peripheral surface of each photoconductor drum 22 after the first transfer has been finished, and the static charge eliminator 28 discharges the peripheral surface of the photoconductor drum 22. Next, in the intermediate transfer section 31, the toner images, which have been first-transferred to the intermediate transfer belt 32, are simultaneously second-transferred to the recording sheet 12 at the second transfer position due to the transfer electric field generated by the second-transfer roller 36, the recording sheet 12 having been transported from the sheet feeder 40 through the sheet feeding path.

After the second transfer has been finished, the recording sheet 12 is peeled off the intermediate transfer belt 32 and transported to the fixing device 45 by the sheet transporting device 49. The fixing device 45 causes the recording sheet 12, on which the toner images have been transferred, to pass through the contact portion between the rotary heating member 47 and the rotary pressing member 48, where the recording sheet 12 is heated and pressed, and thereby toner of the toner image is melted and fixed on the recording sheet 12. When performing simplex printing on the recording sheet 12, after the fixing has been finished, the recording sheet 12 passes through the sheet output path to the outside of the housing 10, and is received by the output tray 13.

Thus, the toner images in four colors are combined to form a full-color image on the recording sheet 12.

Referring to FIGS. 2 and 3, the corona discharger 23K (in the present exemplary embodiment, a scorotron discharger) is used as the charging device 23 of the image forming unit 21K of the image forming apparatus 1. Moreover, the image forming unit includes the blower 5 for blowing air toward the corona discharger 23K (to be specific, toward discharge wires).

Referring to FIGS. 3 to 6, etc., the blower 5 includes a fan 6, which blows air, and an air duct 7. A passage is formed in the air duct 7 to guide the air from the fan 6 to the corona discharger 23K and to blow the air onto the discharge wires stretched across the corona discharger 23K.

Figure 4:
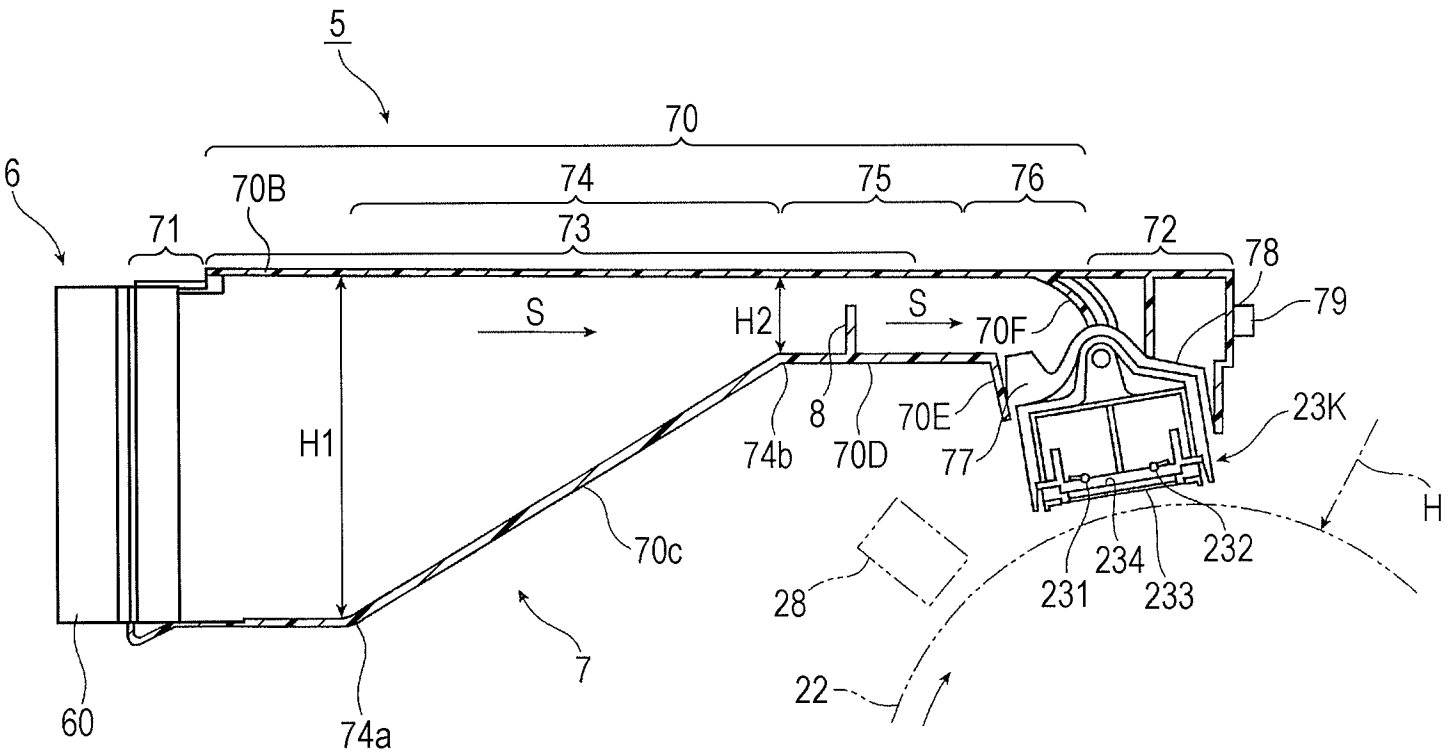
FIG. 4 is a sectional view taken along line IV-IV of FIG. 3.
Figure 7:
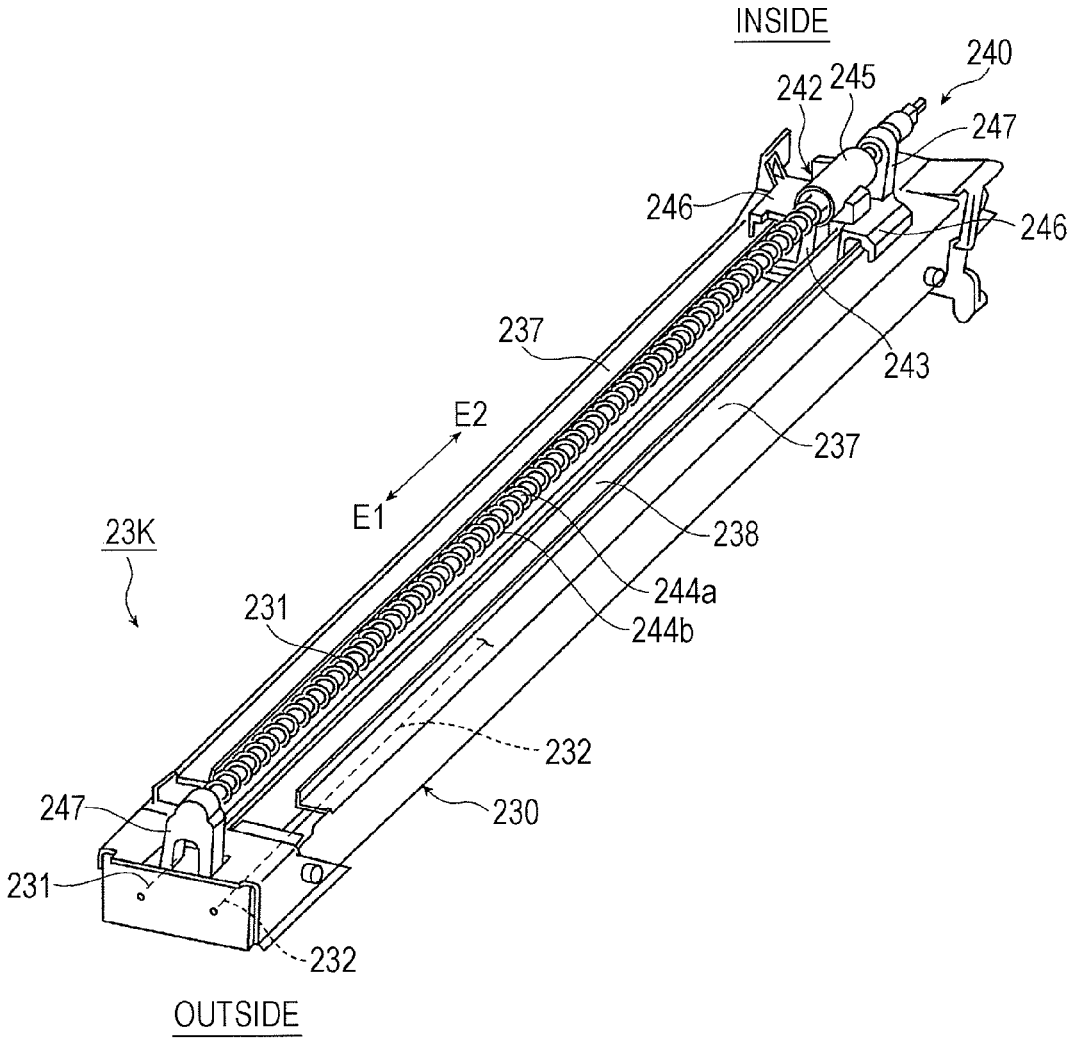
FIG. 7 is a perspective view of the corona discharger to which the blower is applied.

Referring to FIGS. 4, 7, etc., the corona discharger 23K, to which the blower 5 is attached, includes a shield frame 230, two discharge wires (a first discharge wire 231 and a second discharge wire 232), a grid electrode 233, and a cleaning device 240 (FIG. 7). The shield frame 230 extends in the axial direction of the photoconductor drum 22 and has a box-like shape having substantially the same length as the photoconductor drum 22. The first discharge wire 231 and the second discharge wire 232 are linearly stretched across the inner space of the shield frame 230 in the longitudinal direction and fixed to the shield frame 230. The grid electrode 233 is attached to the lower side of the shield frame 230 facing the photoconductor drum 22. The cleaning device 240 cleans at least the two discharge wires 231 and 232.

The shield frame 230 is a rectangular box-shaped structure. The lower side of the shield frame 230 facing the photoconductor drum 22 is open (a lower opening 234). A middle portion of the upper side of the shield frame 230 along the longitudinal direction is open. In plan view, the shield frame 230 has a length that is substantially the same as that of the photoconductor drum 22 in the axial direction. The shield frame 230 has upper side portions 237 that are bent from upper parts of side surfaces, which extend in the longitudinal direction, toward a middle part of the shield frame 230, so that a rectangular gap 238 is formed in the middle part. The inner space of the shield frame 230 is divided into two parts by a partition plate 239 extending in the longitudinal direction.

The two discharge wires 231 and 232 are stretched linearly (parallely) in the axial direction of the photoconductor drum 22 with a distance therebetween and fixed to the ends of the shield frame 230 in the longitudinal direction. The discharge wires 231 and 232 are positioned so as to be separated from the peripheral surface of the photoconductor drum 22 by the same distance. The grid electrode 233 is a thin plate in which meshes or through-holes are formed in a regular pattern. The grid electrode 233 is positioned so as to cover the lower opening 234 in the shield frame 230 and so as to be separated from the two discharge wires 231 and 232 by the same distance.

The corona discharger 23K generates electrical charges (in the present exemplary embodiment, anions) due to corona discharge when charging voltages are applied to the two discharge wires 231 and 232. The electrical charges are transferred to the peripheral surface of the photoconductor drum 22 through spaces in the grid electrode 233, whereby the photoconductor drum 22 is charged.

Referring to FIG. 7, the cleaning device 240 of the corona discharger 23K is configured to clean the two discharge wires 231 and 232 by making a cleaning member to contact the two discharge wires 231 and 232 and reciprocate the cleaning member in directions E (indicated by arrows E1 and E2) in which the discharge wires 231 and 232 are stretched. A moving supporter 242 supports the cleaning member and reciprocates.

The moving supporter 242 includes a supporting body 243, a cylindrical attachment portion 245, and sliding supporters 246. The supporting body 243 supports the cleaning member attached thereto. The cylindrical attachment portion 245 is disposed above the supporting body 243, and is attached to a helical spindle 244 that extends along the discharge wires and rotates above the upper opening (the gap 238 in the middle part) of the shield frame 230. The sliding supporters 246 extend from the supporting body 243 or the cylindrical attachment portion 245 in directions that intersect the direction in which the moving supporter 242 reciprocates. The sliding supporters 246 contact and slide over the surfaces of the upper side portions 237 of the shield frame 230. The helical spindle 244 includes a cylindrical shaft 244*a* and a helical member 244*b* that is a wire wound around the outer periphery of the shaft 244*a*. The ends of the shaft 244*a* of the helical spindle 244 are rotatably supported by bearings 247 that are disposed at the ends of the shield frame 230. Rotation of a motor (not shown) is transmitted to one of the ends of the shaft 244*a*.

When the helical spindle 244 rotates in required directions (in the normal direction and in the reverse direction), the rotation of the helical member 244*b* of the helical spindle 244 is converted to linear motion of the cylindrical attachment portion 245, and thereby the moving supporter 242 reciprocates along the helical spindle 244. Thus, the cleaning member, which is supported by the moving supporter 242 and in contact with the two discharge wires 231 and 232, reciprocates along the discharge wires 231 and 232 and cleans the surfaces of the discharge wires 231 and 232.

The fan 6 of the blower 5 includes a casing 60, a bladed wheel 61, and a motor for rotating the bladed wheel 61. The casing 60 has a rectangular shape (in the present embodiment, a square shape) and has a cylindrical space extending therethrough. The bladed wheel 61 is supported so as to rotate in the cylindrical space of the casing 60. The bladed wheel 61 includes a cylindrical rotor 61*a* and plural (propeller-shaped) blades 61*b*. The rotor 61*a* is disposed so that the axis thereof extends in a direction in which air is moved. The blades 61*b* protrude from the peripheral surface of the rotor 61*a* in radial directions with a required tilt angle with respect to the axial direction. The bladed wheel 61 is, for example, directly attached to the driving shaft of the motor, which is disposed inside the rotor 61*a*, and is rotated by the driving force of the motor.

The fan 6 is a so-called axial fan, with which, when the bladed wheel 61 rotates, the blades 61*b* swirl air around the rotor 61*a* and move the air linearly in the axial direction. A supporting frame 63, which is illustrated in FIG. 3 etc., rotatably supports the rotor 61*a*. The supporting frame 63 includes an annular portion 63*a* and arms 63*b*. The annular portion 63*a* supports one end of the rotor 61*a*. The arms 63*b* diagonally extend from the outer peripheral surface of the annular portion 63*a* with required distances therebetween and connected to the casing 60 at regular intervals.

The fan 6 is disposed close to a side panel 10A of the housing 10 of the image forming apparatus 1, so that the fan 6 is capable of taking in air from the outside of the housing 10. Referring to FIG. 2, in the first exemplary embodiment, an intake duct 65 is disposed so as to connect an air intake 11, which is formed in the side panel 10A of the housing 10, to the fan 6. A filter (not shown) is disposed in the air intake 11 to remove dust from the air that is taken in from the outside.

The air duct 7 is a tube-shaped structure including a body portion 70, a fan connecting portion 71, and a discharger connecting portion 72. The body portion 70 has a passage formed therein. The fan connecting portion 71, which is at one end of the body portion 70, has an opening formed therein, and an end of the casing 60 of the fan 6 in a direction in which air is blown is fit into and connected to the opening. The discharger connecting portion 72, which is at the other end of the body portion 70, has an opening formed therein, and a part of the corona discharger 23K to which air is blown is connected to the opening. In the first exemplary embodiment, the air duct 7 extends in a substantially horizontal direction from the fan 6 toward the corona discharger 23K, and is connected to an upper part of the corona discharger 23K. The air duct 7 is, for example, made from a synthetic resin by using an appropriate plastic molding method.

Figure 5:
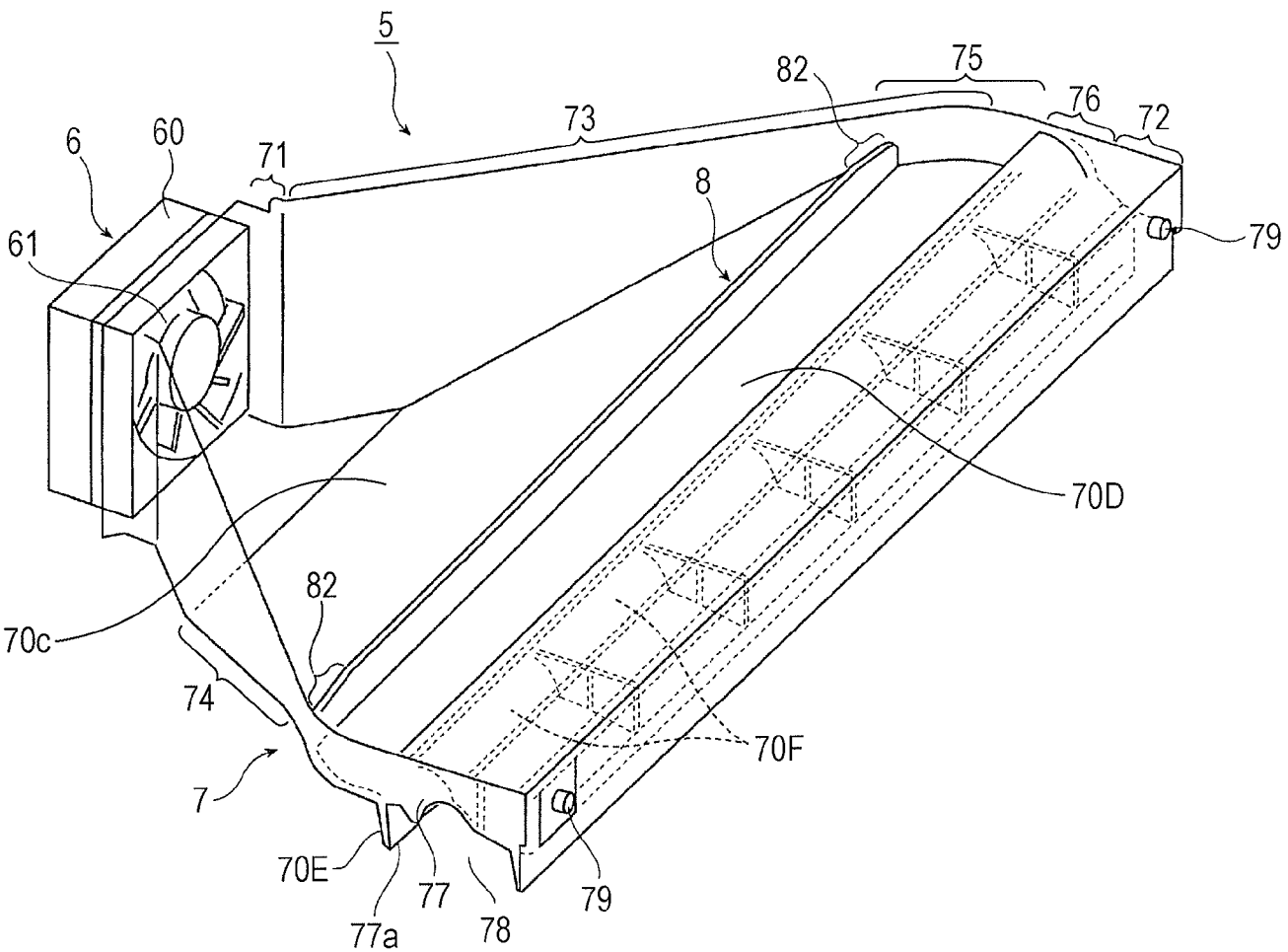
FIG. 5 is a perspective view of the blower of FIG. 3 from which a corona discharger and a top plate are removed.
Figure 6:
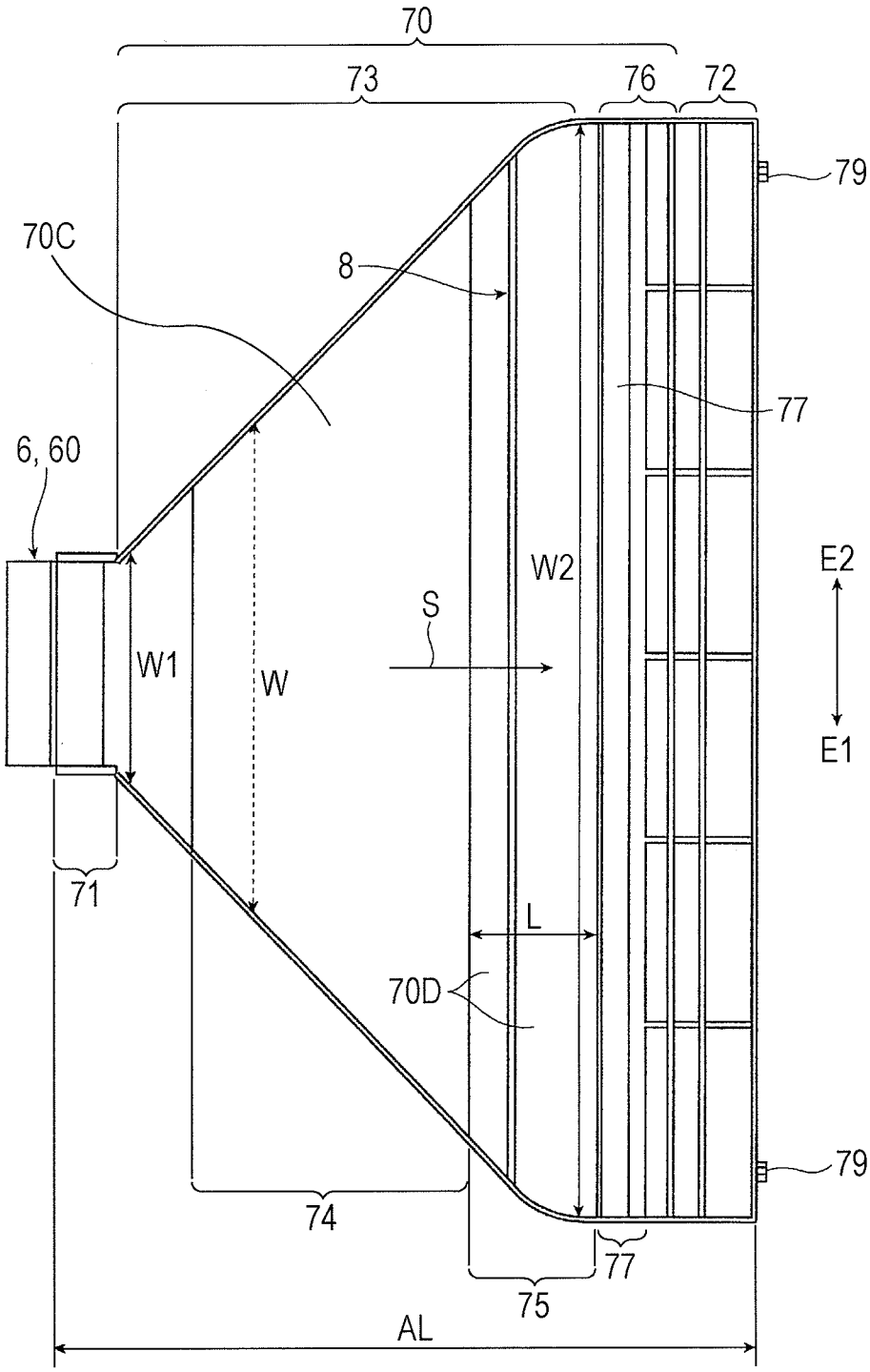
FIG. 6 is a plan view (top view) of the blower of FIG. 5.

Referring to FIGS. 5, 6, etc., the passage in the body portion 70 includes an increasing-width portion 73, a decreasing-height portion 74, an extension portion 75, a bent portion 76, and an opening 77. In the increasing-width portion 73, a passage width W, which is the dimension of the passage in the direction E in which the discharge wire 231 (232) is stretched, gradually decreases downstream in an air flow direction S. The decreasing-height portion 74 is a part of the increasing-width portion 73. In the decreasing-height portion 74, a passage height H, which is the height of the passage, decreases downstream in the air flow direction S. The extension portion 75 extends from a downstream end 74*b* of the decreasing-height portion 74 to a position close to the corona discharger 23K. The extension portion 75 has a constant height H2 that is the same as the height at the downstream end 74*b*. The bent portion 76 is bent from a downstream end 75*b* of the extension portion 75 toward the corona discharger 23K so as to be connected to the corona discharger 23K. The opening 77 is formed at a downstream end of the bent portion 76 in the air flow direction S. The opening has a width W3 that corresponds to at least the length of the effective part of the discharge wire 231 with respect to the direction E in which the discharge wire 231 is stretched. A positioning boss 79, which is illustrated in FIG. 4 etc., is inserted into a positioning hole when the air duct 7 is attached to an attachment portion of the housing 10 of the image forming apparatus 1.

The increasing-width portion 73 is configured so that the passage width W increases linearly and laterally symmetrically with respect to the air flow direction S from the fan connecting portion 71, which is quadrangular. The decreasing-height portion 74, in which the passage height H decreases, is formed by a top plate and an inclined plate disposed below the top plate. The top plate is a part of an upper plate 70B of the body portion 70. (At least the inner surface of the top plate is flat.) The inclined plate is a lower plate 70C of the body portion 70 in the middle of the increasing-width portion 73, and the inclined plate is linearly inclined toward the upper plate 70B. (At least the inner surface of the inclined plate is flat.) The decreasing-height portion 74 has a height H1 at an upstream end 74*a* and has a height H2 (>H1) at the downstream end 74*b*. The extension portion 75, in which the height H1 is constant, is a passage that extends from the downstream end 74*b* of the decreasing-height portion 74, which is a part of the increasing-width portion 73, to an end thereof that is near the corona discharger 23K (shield frame 230). The extension portion 75 has a length L (FIG. 6). The extension portion 75 is formed by a top plate and a second bottom plate disposed below the top plate. The top plate is a part of the upper plate 70B. The second bottom plate is a second lower plate 70D of the body portion 70, which extends substantially parallel to the top plate and is separated from the top plate by a distance corresponding to the passage height H2. (At least the inner surface of the second bottom plate is flat.)

Figure 8:
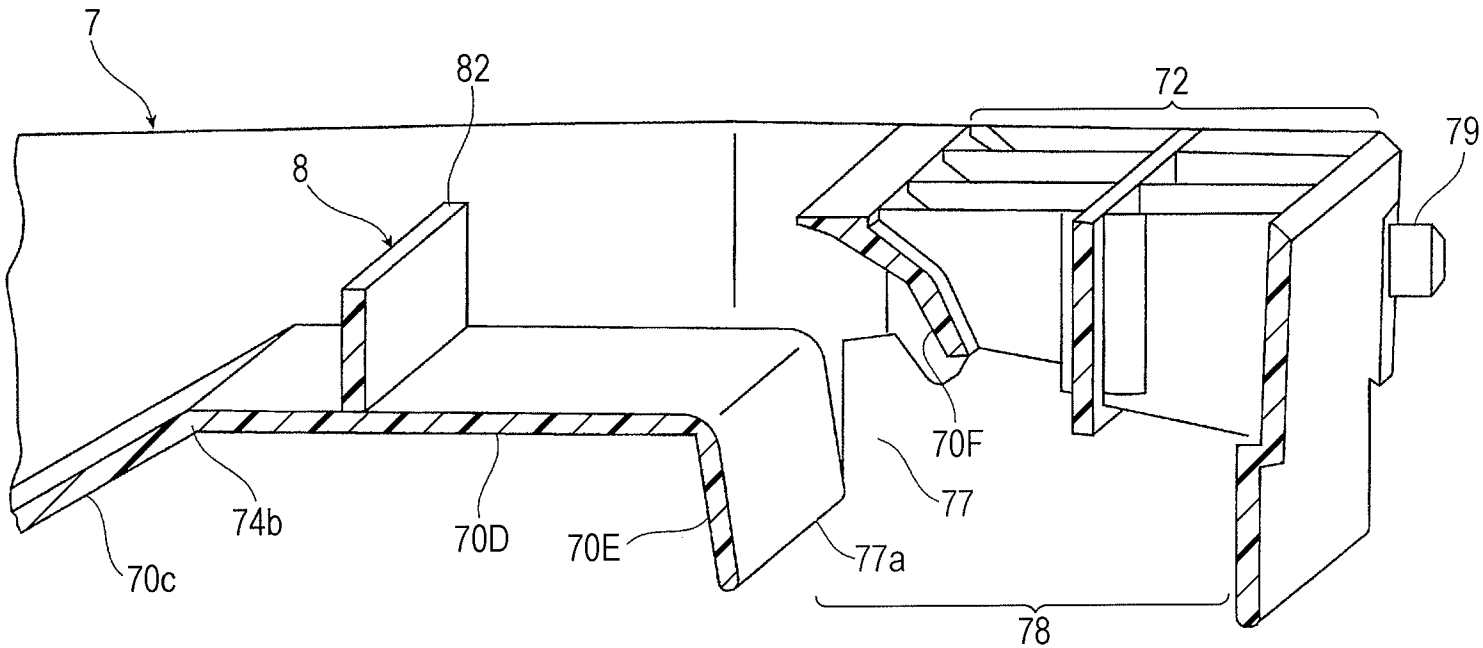
FIG. 8 is a sectional perspective view illustrating the structures of a bent portion and a discharger-connecting-end portion of an air duct of the blower of FIG. 5.

Referring to FIGS. 4 and 8, the bent portion 76 is formed so as to be bent downward from the downstream end 75*b* of the extension portion 75 at substantially a right tangle. In the bent portion 76, the passage height H2 is substantially constant. The bent portion 76 is a passage surrounded by a lower bent plate 70E and an upper curved plate 70F. The opening 77 in the bent portion 76 has a shape such that the opening 77 is connectable to an upper portion of the corona discharger 23K, and, to be specific, connectable to at least an air intake portion (the gap 238) of the upper portion. Referring to FIGS. 4 and 8, a connection opening 78 is formed in the discharger connecting portion 72 so as to cover the entire upper portion of the corona discharger 23K to which air is blown, including the discharge wire 231, from above. The opening 77 in the bent portion 76 is included in the connection opening 78. Side panels are on both sides of the body portion 70 of the passage with respect to the air flow direction S. The side panels stand substantially vertically and at least the inner surfaces of the side panels are flat.

In the passage in the air duct 7, an adjustment plate 8 is disposed on the inner wall of the extension portion 75 on the corona discharger 23K side (the inner surface of the second lower plate 70D). The adjustment plate 8 is a plate-shaped member that extends in the direction E in which the discharge wire 231 is stretched and over the entire passage width W.

Figure 9:
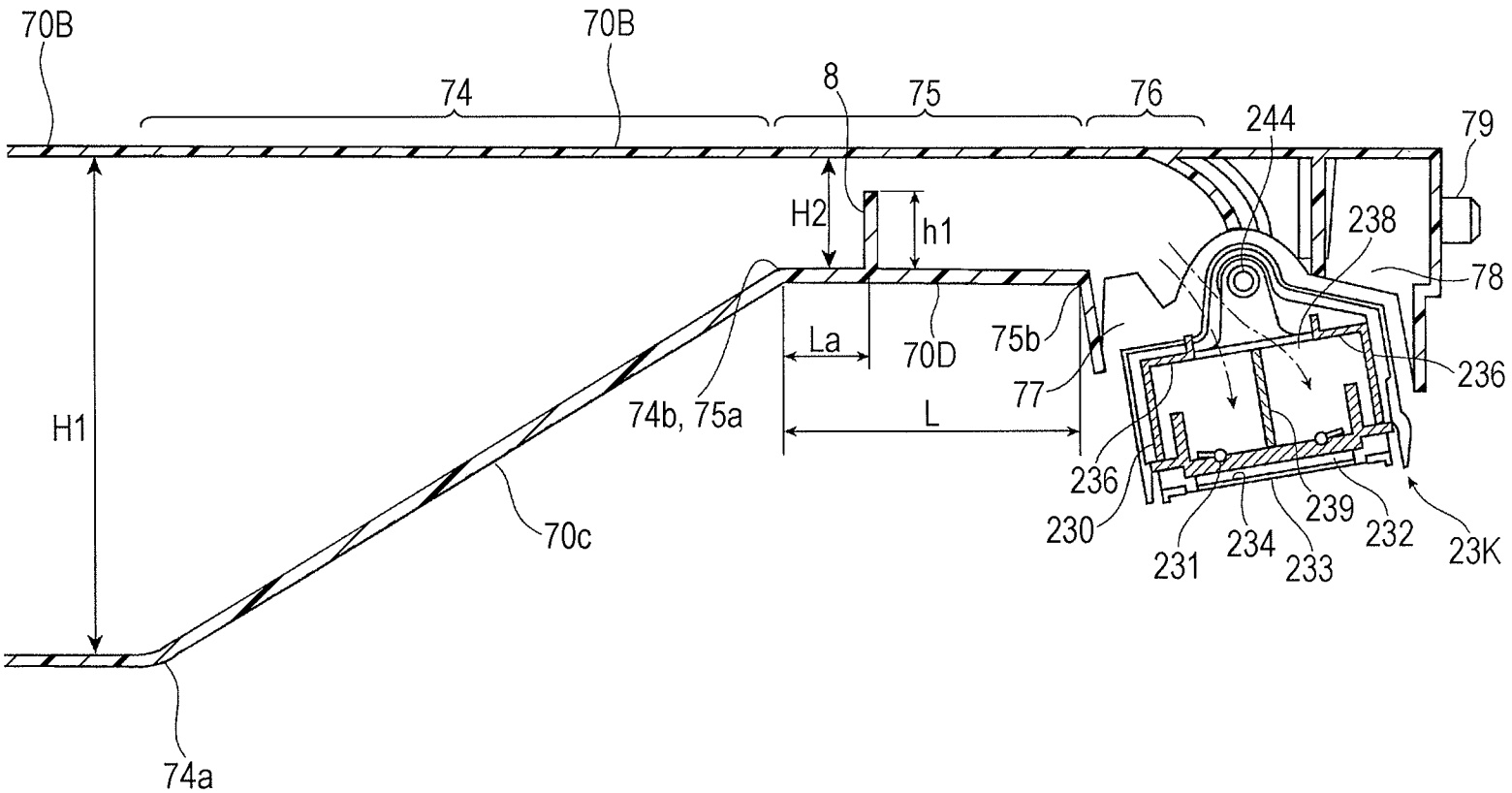
FIG. 9 illustrates the structure and the dimensions of a part of the air duct near the corona discharger of FIG. 4.

Referring to FIG. 9 etc., in the first exemplary embodiment, the adjustment plate 8 is disposed in the passage at a position separated by a distance La from an upstream end 75*a* of the extension portion 75 (the downstream end 74*b* of the decreasing-height portion 74) downstream in the air flow direction S (at a position slightly upstream of the center of the extension portion 75). The extension portion 75 has the height H2, and the adjustment plate 8 has a height h1 (which is the height to which the adjustment plate 8 protrudes from the inner surface of the second lower plate 70D). The height h1 of the adjustment plate 8 is, for example, in the range of 50 to 70% of the height H2 of the extension portion 75. The thickness of the adjustment plate 8 is, for example, about the same as the thickness of the plates that constitute the air duct 7. The shape of the adjustment plate 8 along the passage width W is rectangular. The adjustment plate 8 stands substantially perpendicularly on the inner surface of the second lower plate 70D.

The entirety of the adjustment plate 8 may be a flat plate. Alternatively, the adjustment plate 8 may have a shape such that the thickness of a lower portion thereof is larger than that of an upper portion thereof. The adjustment plate 8 may be independent from the air duct 7. In this case, the adjustment plate 8 is attached to the inner wall of the second lower plate 70D of the extension portion 75 by using a required fastener. Alternatively, the adjustment plate 8 may be integrally formed with the air duct 7.

The blower 5 is driven at a required timing such as when the image forming apparatus 1 performs an image forming operation or when the image forming apparatus 1 stands by. At such a timing, the fan 6 of the blower 5 is driven and the bladed wheel 61 rotates. Thus, the fan 6 blows air, the air passes through the passage in the air duct 7, and the air is blown onto the discharge wires 231 and 232 of the corona discharger 23K.

That is, air that is blown by the fan 6 passes through the increasing-width portion 73, the decreasing-height portion 74, the extension portion 75, and the bent portion 76 of the passage in the air duct 7, and then is blown out of the opening 77 in the bent portion 76. Thereafter, the air that is blown out of the opening 77 passes through the gap 238, which is formed between the upper side portions 237 of the shield frame 230 of the corona discharger 23K, flows into the inner space in the shield frame 230, and is blown onto the two discharge wires 231 and 232.

To be specific, when the air from the fan 6 passes through the increasing-width portion 73 of the air duct 7, the air spreads toward both sides with respect to the air flow direction S. When the air passes through the decreasing-height portion 74 of the air duct 7, the air becomes compressed gradually. When the air passes through the extension portion 75, which is a substantially uniform space, in a substantially uniform state. When the air passes through the bent portion 76, the direction of the air is changed downward, and then the air passes through the opening 77 and the gap 238 in the shield frame 230 of the corona discharger 23K. Finally, the air is blown into the inner space of the shield frame 230.

At this time, the air is blown out of the fan 6 in a swirling state as described above. However, because a part of the air collides with the adjustment plate 8 in the extension portion 75 of the air duct 7, the swirling (swirling flow) of the air is reduced, and the air is blown onto the discharge wires 231 and 232 with a substantially uniform speed with respect to the direction E in which the discharge wires 231 and 232 are stretched.

As a result, the blower 5 smoothly blows air onto the discharge wires 231 and 232 of the corona discharger 23K. Therefore, dust in the air, such as corona by-products and paper powder, is prevented from non-uniformly adhering to the discharge wires in the direction E in which the discharge wires are stretched. Thus, the corona discharger 23K prevents non-uniform discharge, which may occur if dust adheres to the discharge wires 231 and 232 non-uniformly in the direction in which the discharge wires 231 and 232 are stretched. Moreover, in the image forming unit 21K including the corona discharger 23K, the photoconductor drum 22 is uniformly and appropriately charged by the corona discharger 23K, whereby a decrease in the quality of an image due to image defects (such as, non-uniform density and unwanted lines), which may be caused by non-uniform charging, is prevented.

Figure 10A:
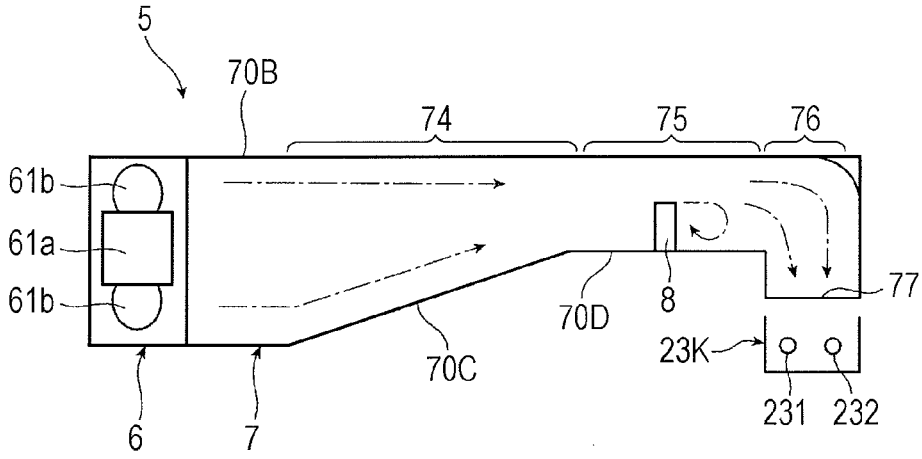
FIG. 10A is a schematic view illustrating the configuration of the blower according to the first exemplary embodiment.
Figure 10B:
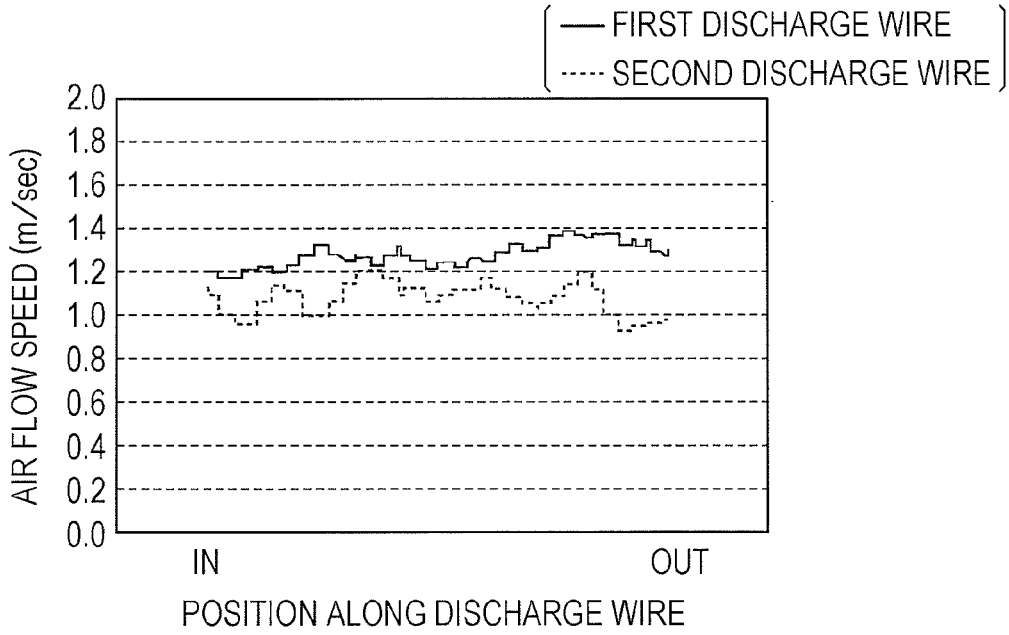
FIG. 10B is a graph illustrating the result of measuring the velocity distribution of air blown by the blower illustrated in FIG. 10A.

FIG. 10A is a schematic view illustrating the configuration of the blower 5 according to the first exemplary embodiment, and FIG. 10B is a graph illustrating the result of measuring the air flow characteristic of the blower 5.

In this case, an axial fan including the casing 60 with having dimensions of 60 mm×60 mm and the bladed wheel 61 having seven blades 61*b* was used as the fan 6 of the blower 5. During the measurement, the fan was driven to generate airflow of about 0.4 $m^3$/min.

Referring to FIGS. 6, 9, etc., an air duct having the following dimensions was used as the air duct 7 of the blower 5. The total length AL of the body portion 70, the fan connecting portion 71, and the discharger connecting portion 72 was about 360 mm. The minimum passage width W1 of the increasing-width portion 73 (which is the same as the width of the fan connecting portion 71) was about 60 mm. The maximum passage width W2 of the increasing-width portion 73 (which corresponds to the passage width of the bent portion 76) was about 360 mm. The height H1 of the decreasing-height portion 74 at the upstream end 74*a* was about 60 mm. The height H2 of the decreasing-height portion 74 at the downstream end 74*b* was about 16 mm. The length L of the second lower plate 70D of the extension portion 75 in the air flow direction S was about 40 mm. As the adjustment plate 8 of the air duct 7, a rectangular flat plate having a height h1 of about 10 mm, a length of about 340 mm, and a thickness of about 2 mm was used. The flat plate was disposed at a position separated from the upstream end 75*a* of the extension portion 75 by a distance La of about 13 mm downstream in the air flow direction S. The flat plate stood substantially vertically on the inner surface of the second lower plate 70D.

As the corona discharger 23K, a corona discharger having the gap 238, which has a rectangular shape having dimensions 20 mm×360 mm, formed in the upper portion of the shield frame 230 was used. The speed of air blown onto the two discharge wires 231 and 232 of the corona discharger 23K was measured as the air flow characteristic. The measurement was carried out at plural positions in divided regions of each of the discharge wires 231 and 232 between the IN side (the back side of the apparatus) and the OUT side (the front side of the apparatus). FIG. 10B illustrates the measurement result. In FIG. 10B, "FIRST DISCHARGE WIRE" is the discharge wire 231, which is disposed near to the static charge eliminator 28 of the image forming unit 21K, and "SECOND DISCHARGE WIRE" is the discharge wire 232, which is disposed near the position at which the photoconductor drum 22 of the image forming unit 21K is irradiated with the light beam B emitted by the exposure device 24.

Referring to FIG. 10B, air from the fan 6 was blown onto both of the two discharge wires 231 and 232 with substantially the same speed. Moreover, the air is blown with a substantially uniform speed onto each of the wires with respect to the direction E in which the wires are stretched (the regions between the IN side and the OUT side). For the blower 5, the speed of air blown onto the discharge wires 231 and 232 may be, for example, equal to or higher than 0.8 m/s. FIG. 10A illustrates estimated flow of air blown by the fan 6. In particular, it is estimated that, after the air has passed the adjustment plate 8, a part the air is uniformly disturbed to generate small vortices, and thereby the air is blown out of the opening 77 in the bent portion 76 of the air duct 7 with approximately the same speed regardless of whether the air passes through the inner part or the outer part of the bent portion 76.

Figure 13A:
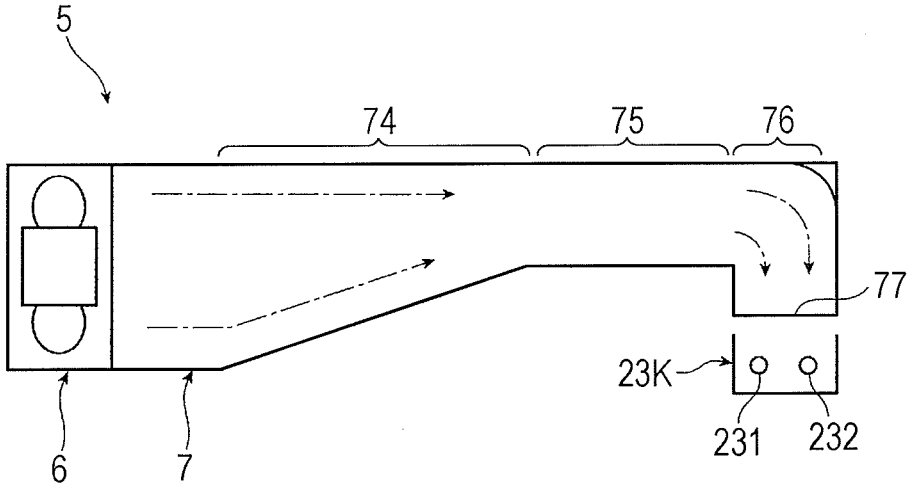
FIG. 13A is a schematic view of a modification of the blower according to the first exemplary embodiment (in which the adjustment plate is not provided)
Figure 13B:
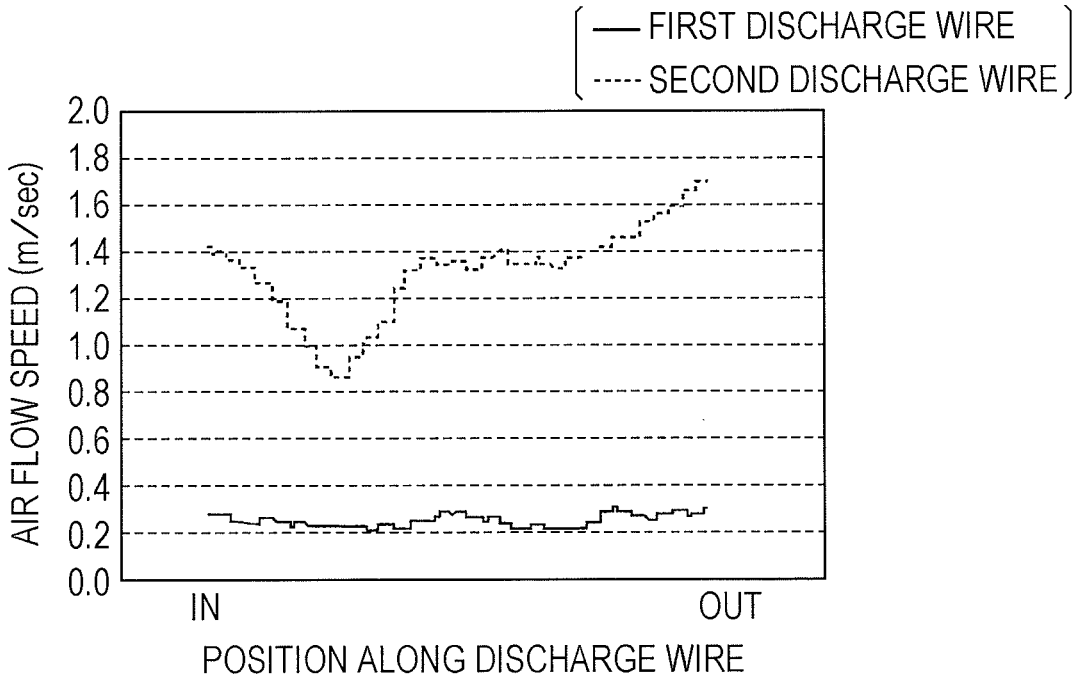
FIG. 13B is a graph illustrating the result of measuring the velocity distribution of air blown by the blower illustrated in FIG. 13A.

Referring to FIGS. 13A and 13B, for reference purposes, the air flow characteristic of the blower 5 including the air duct 7 without the adjustment plate 8 was measured. FIG. 13A illustrates the blower 5, and FIG. 13B illustrates the result of the measurement.

In this case, as is clear from FIG. 13B, air from the fan 6 is almost concentratedly blown onto the second discharge wire 232. Presumably, this is because the air blown by the fan 6 flows concentratedly along the inner surface on the outer side of the bent portion 76 of the air duct 7 and flows dispersedly along the inner surface on the inner side of the bent portion 76 (on the corona discharger side). Moreover, the speed of the air that is blown onto the second discharge wire 232 was considerably non-uniform. Presumably, this is because swirling of air, which was generated when the air was blown by the fan 6, was not suppressed and directly influenced the airflow.

Figure 14A:
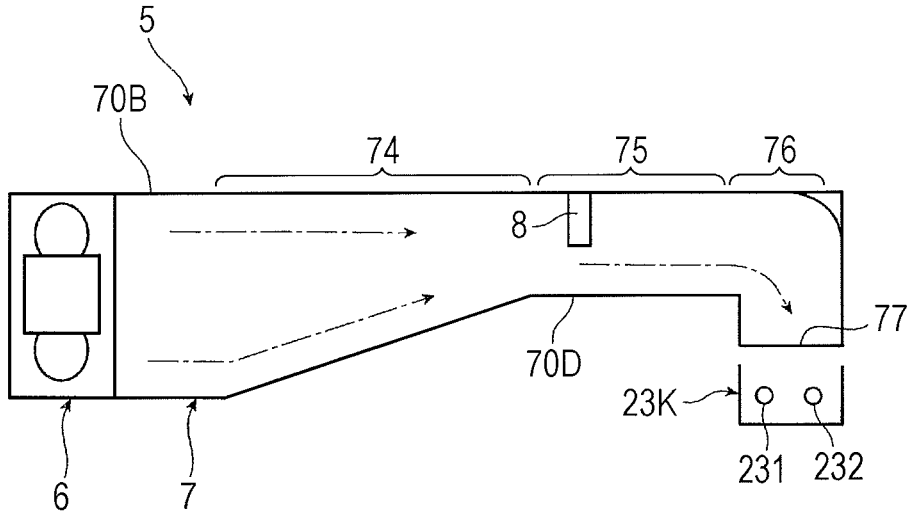
FIG. 14A is a schematic view of a modification of the blower according to the first exemplary embodiment (in which the position of the adjustment plate on an inner wall is changed)
Figure 14B:
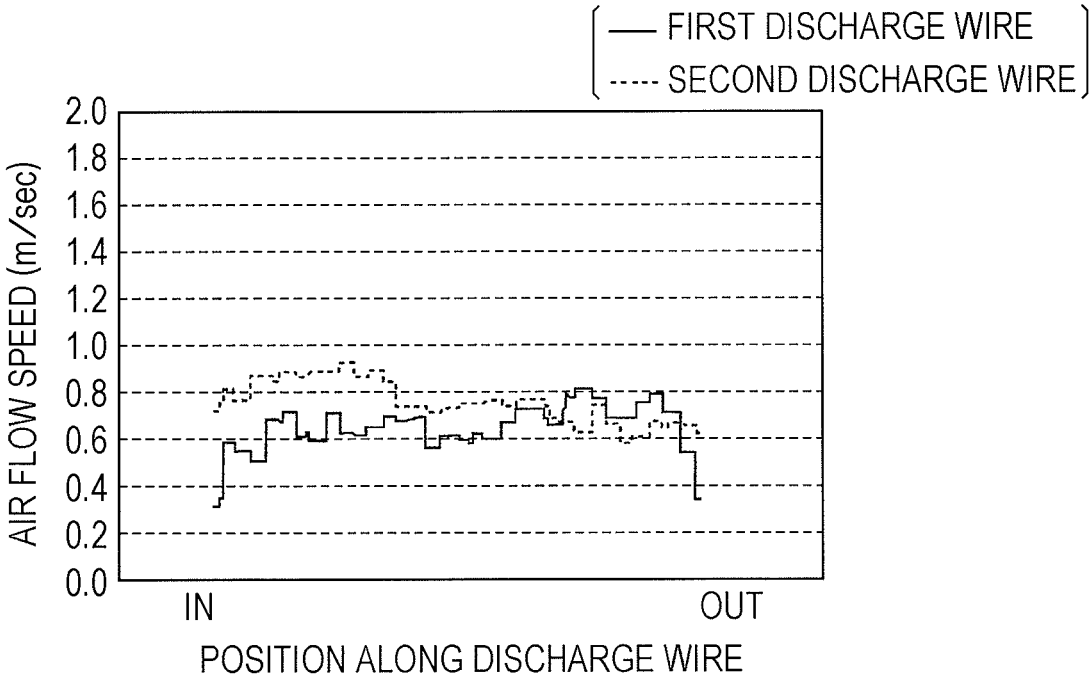
FIG. 14B is a graph illustrating the result of measuring the velocity distribution of air blown by the blower illustrated in FIG. 14A.

Referring to FIGS. 14A and 14B, for reference purposes, the air flow characteristic of the blower 5 including the air duct 7 in which the adjustment plate 8 was disposed on a side of the inner wall of the extension portion 75 opposite to the corona discharger 23K side (the inner wall of the upper plate 70B of the body portion 70 of the passage) was measured. FIG. 14A illustrates the blower 5, and FIG. 14B illustrates the result of the measurement.

In this case, as is clear from FIG. 14B, although the air from the fan 6 was blown toward the first discharge wire 231 and the second discharge wire 232, the air flow speed was low (slow). Moreover, the speed of air blown onto the discharge wires 231 and 232 was lower than 0.8 m/s, which was the tolerance level, for more than half of the regions of the wires.

Figure 11A:
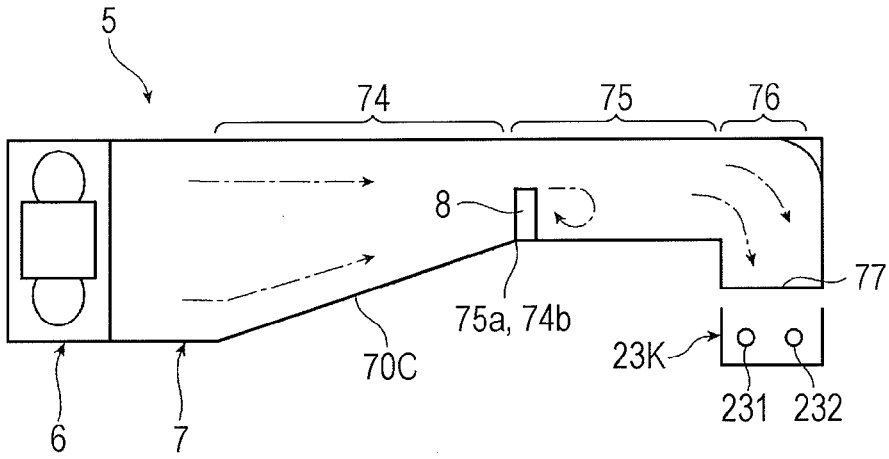
FIG. 11A is a schematic view of a modification of the blower according to the first exemplary embodiment (in which the position of an adjustment plate is changed)
Figure 11B:
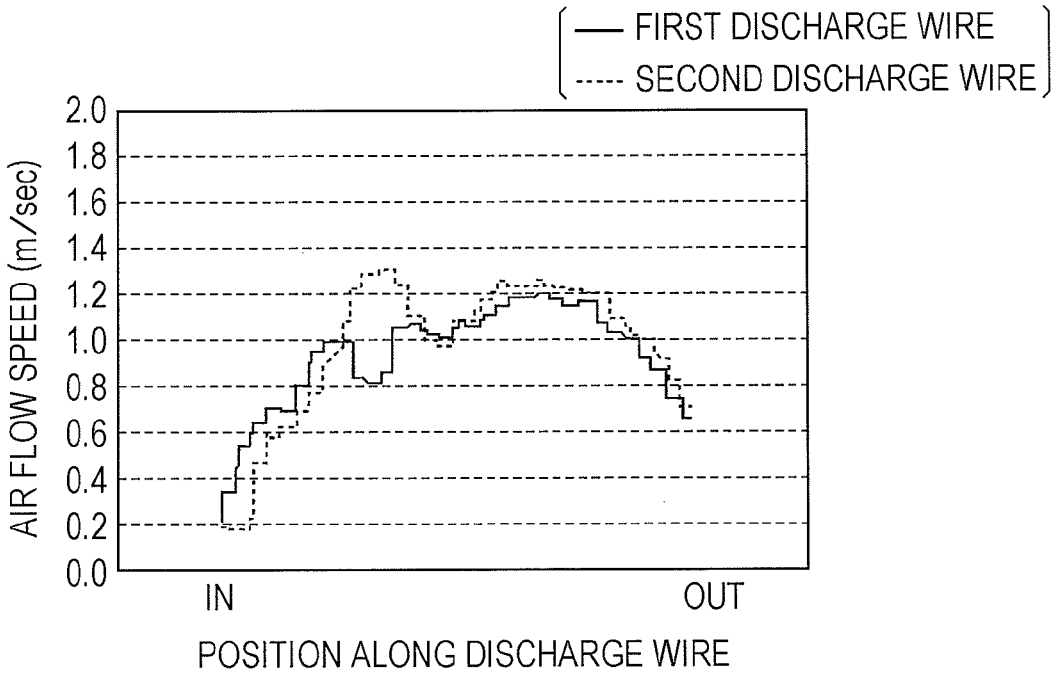
FIG. 11B is a graph illustrating the result of measuring the velocity distribution of air blown by the blower illustrated in FIG. 11A.

Referring to FIG. 11A, the blower 5 according to the first exemplary embodiment including the air duct 7 in which the adjustment plate 8 was disposed at the upstream end 75*a* of the extension portion 75 (in other words, the downstream end 74*b* of the decreasing-height portion) was prepared. The air flow characteristic of the blower 5 was measured, and FIG. 11B illustrates the result of the measurement. In this case, as is clear from FIG. 11B, the air blown by the fan 6 is blown onto the two discharge wires 231 and 232 with approximately the same speed. However, the air flow speeds at end portions of the discharge wires in the direction E in which the wires were stretched were lower than the air flow speed in the middle portion of the discharge wire.

Figure 12A:
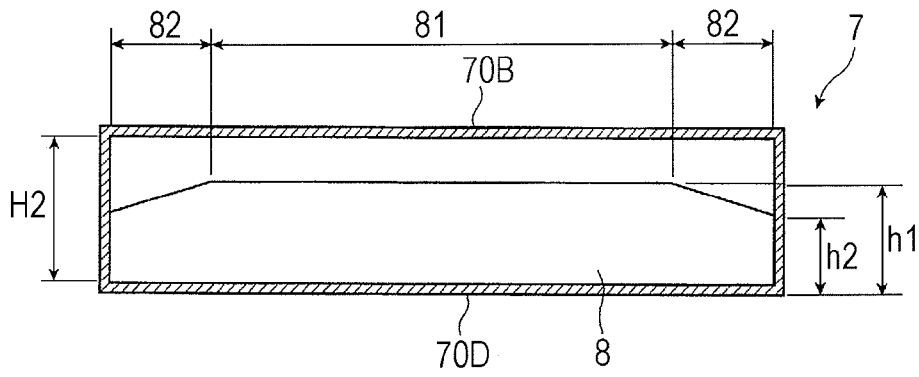
FIG. 12A is a schematic view of a modification of the blower according to the first exemplary embodiment (in which the heights of end portions of the adjustment plate are changed)

Referring to FIG. 12A, the blower 5 according to the first exemplary embodiment including the air duct 7 having the following structure was prepared. In the air duct 7, the adjustment plate 8 was disposed at the upstream end 75*a* of the extension portion 75 as illustrated in FIG. 11A. Moreover, the adjustment plate 8 had low portions 82 having a height h2 (from the inner wall of the extension portion 75) at both ends thereof, the height h2 being lower than the height h1 of a middle portion 81 of the adjustment plate 8. The low portions 82 each had an inclined top surface that extended inward from both ends of the adjustment plate 8 by a width of about 20 mm, and the smallest height h2 of the low portions 82 was 9 mm. That is, the difference in the height within the low portions 82 was about 1 mm. The air flow characteristic of the blower 5 was measured, and FIG. 12B illustrates the result of the measurement.

Figure 12B:
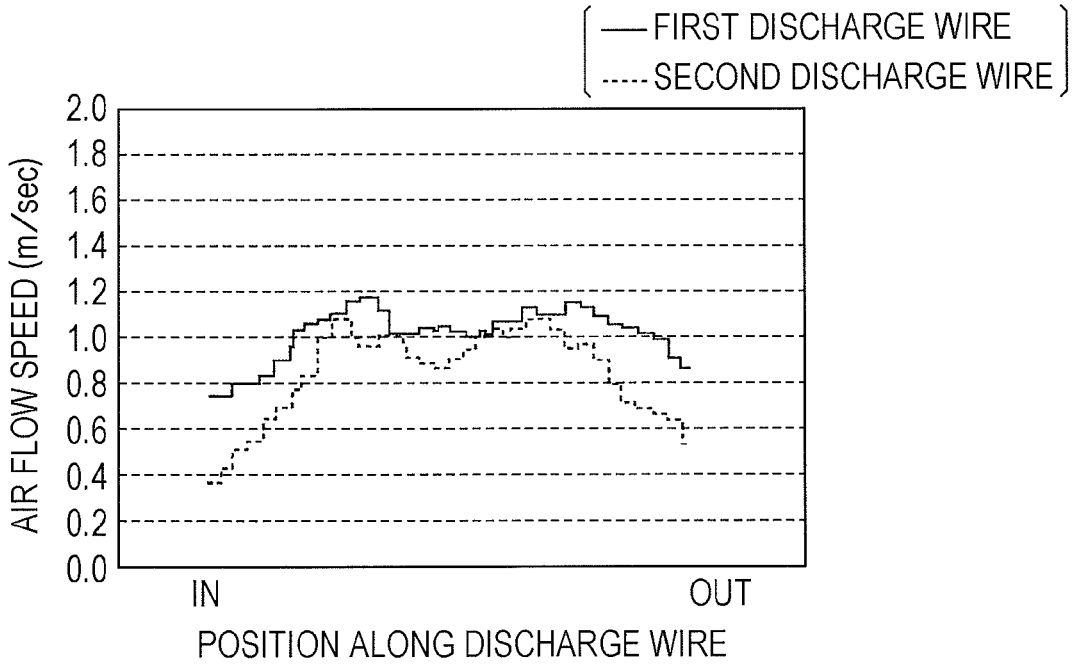
FIG. 12B is a graph illustrating the result of measuring the velocity distribution of air blown by the blower illustrated in FIG. 12A.

In this case, as is clear from FIG. 12B, as compared with the result illustrated in FIG. 11B, the speed of air blown by the fan 6 was higher at both ends of the discharge wires in the direction E in which the wires were stretched (the IN side and the OUT side), which shows an improvement.

Figure 15A:
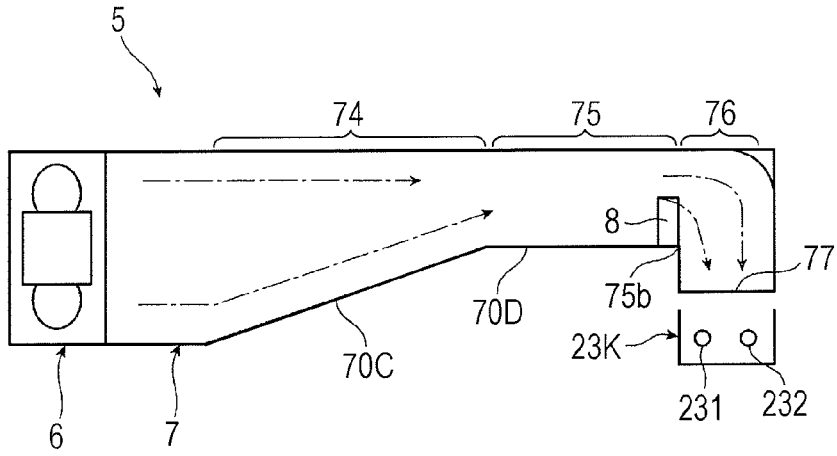
FIG. 15A is a schematic view of a modification of the blower according to the first exemplary embodiment (in which the position of the adjustment plate is changed)

Referring to FIG. 15A, the blower 5 according to the first exemplary embodiment including the air duct 7 in which the adjustment plate 8 was disposed at the downstream end 75*b* of the extension portion 75 (in other words, the upstream end of the bent portion) was prepared. The air flow characteristic of the blower 5 was measured, and FIG. 15B illustrates the result of the measurement.

Figure 15B:
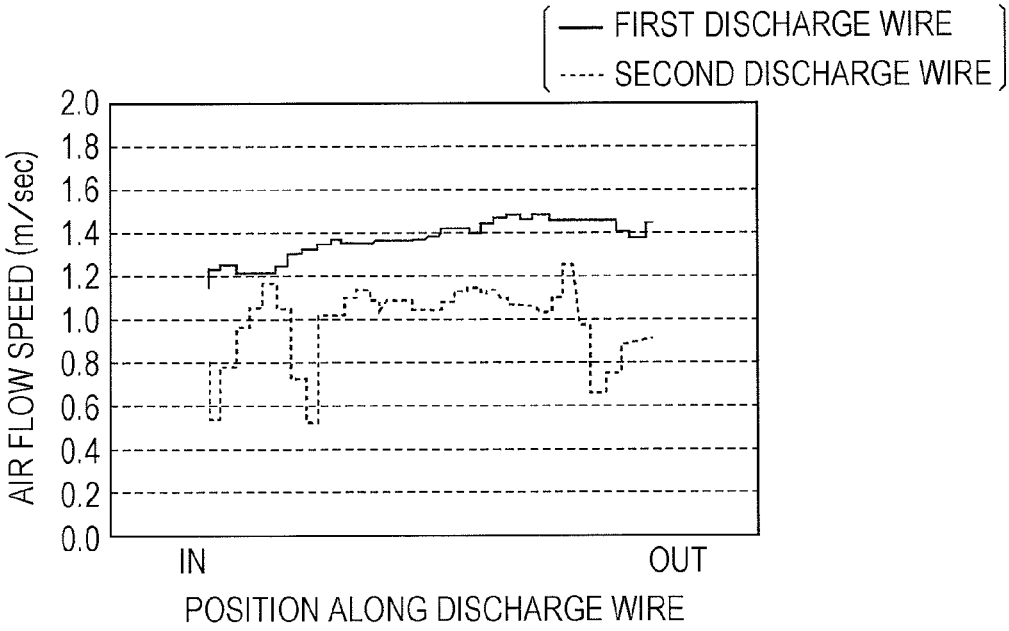
FIG. 15B is a graph illustrating the result of measuring the velocity distribution of air blown by the blower illustrated in FIG. 15A.

In this case, as is clear from FIG. 15B, the speed of air blown by the fan 6 onto the discharge wire 231 (first discharge wire) was 1.2 to 1.4 times higher than the speed of air blown onto the discharge wire 232 (second discharge wire). That is, the air blown by the fan 6 was not blown onto the two discharge wires 231 and 232 with approximately the same speed. The blower 5 having such an air flow characteristic is not appropriate.

Other Exemplary Embodiments

Figure 16:
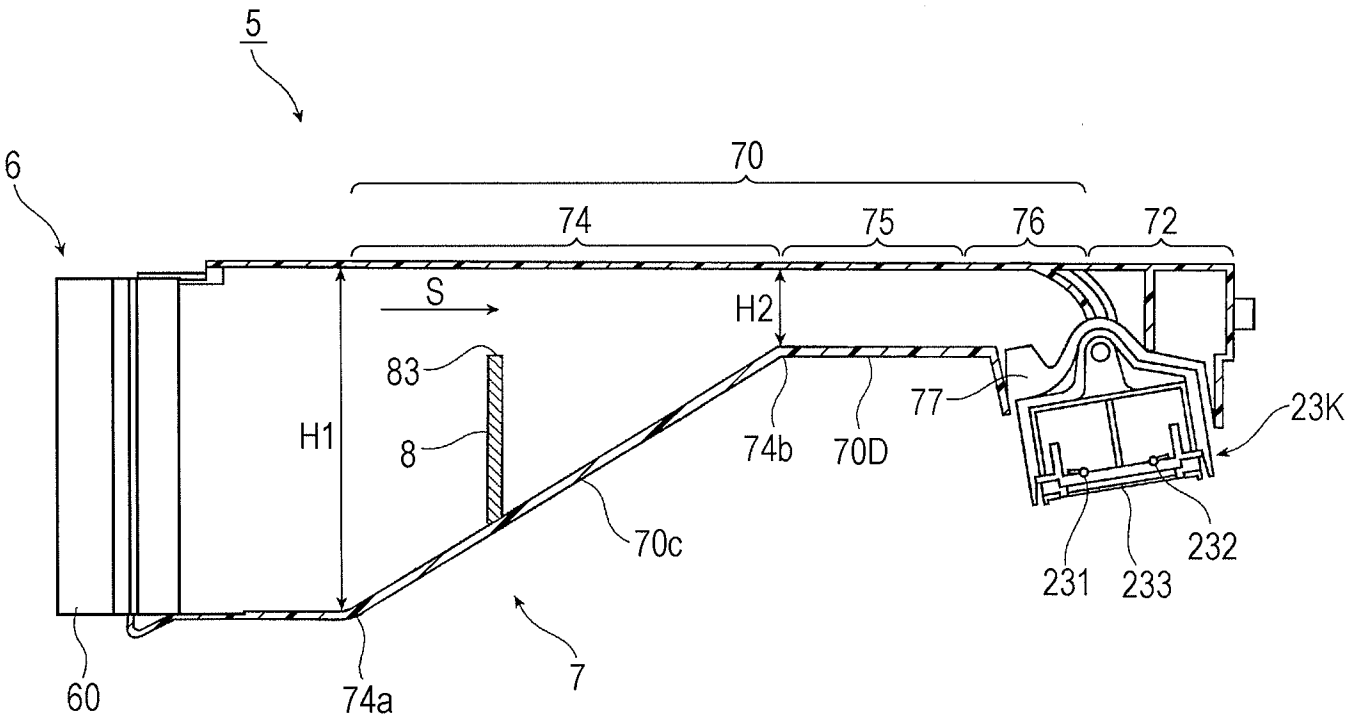
FIG. 16 is a partial sectional view of the blower including an air duct in which the position of the adjustment plate is changed.

In the blower 5 according to the first exemplary embodiment, the adjustment plate 8 is disposed in the extension portion 75 of the air duct 7. However, referring to FIG. 16, in the blower 5, the adjustment plate 8 may be disposed, for example, in the decreasing-height portion 74 of the air duct 7.

Plural adjustment plates 8 may be disposed in the air duct 7 of the blower 5. One adjustment plate 8 may be disposed in the extension portion 75 and another adjustment plate 8 may be disposed in the decreasing-height portion 74.

Figure 17:
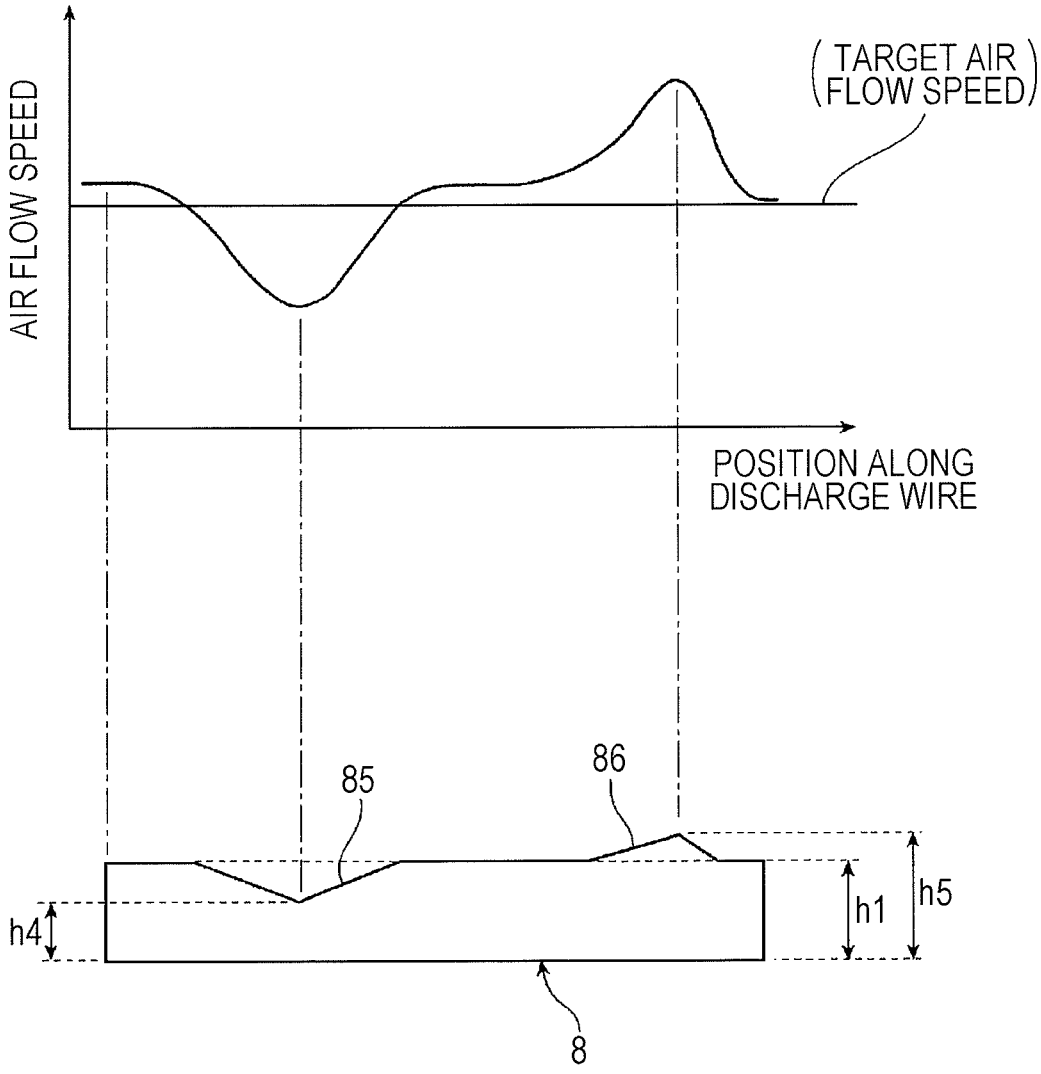
FIG. 17 illustrates an exemplary configuration of an adjustment plate including portions having different heights.

Referring to FIG. 17, the adjustment plate 8, which is disposed in the air duct 7 of the blower 5, may have a shape such that the height h varies along the passage width W (in the direction E).

The adjustment plate 8 illustrated in FIG. 17, whose height h varies, includes a low portion 85 and a high portion 86. The low portion 85 has a height h4 that is smaller than h1 (the standard (reference) height of the adjustment plate 8). The high portion 86 has a height h5 that is larger than h1. The low portion 85 and the high portion 86 may be formed, for example, in accordance with air flow data that is obtained by measuring the air flow (distribution) at the corona discharger 23K when the adjustment plate 8 having the standard height h1 is used. The low portion 85 is formed as an inverted triangular cutout in a portion of the adjustment plate 8, the portion substantially corresponding to regions of the discharge wires in which the air flow speed is lower than a target air flow speed with respect the direction E in which the discharge wires are stretched. The high portion 86 is formed as a triangular protrusion on a portion of the adjustment plate 8, the portion substantially corresponding to region of the discharge wires in which the air flow speed is higher than the target air flow speed.

The adjustment plate 8 having the low portion 85 and the high portion 86 has a shape that is adjusted for the non-uniformity in the air flow speed that actually occurs if the height h of the adjustment plate 8 is uniform. Therefore, when the air duct 7 having such an adjustment plate 8 is used, the air blown by the fan 6 is blown onto the corona discharger 23K with a more substantially and appropriately uniform (improved) air flow speed. The numbers and the types (height, shape, etc.) of the low portion 85 and the high portion 86 are not limited to the example illustrated in FIG. 17, and may be changed as appropriate.

Figure 18:
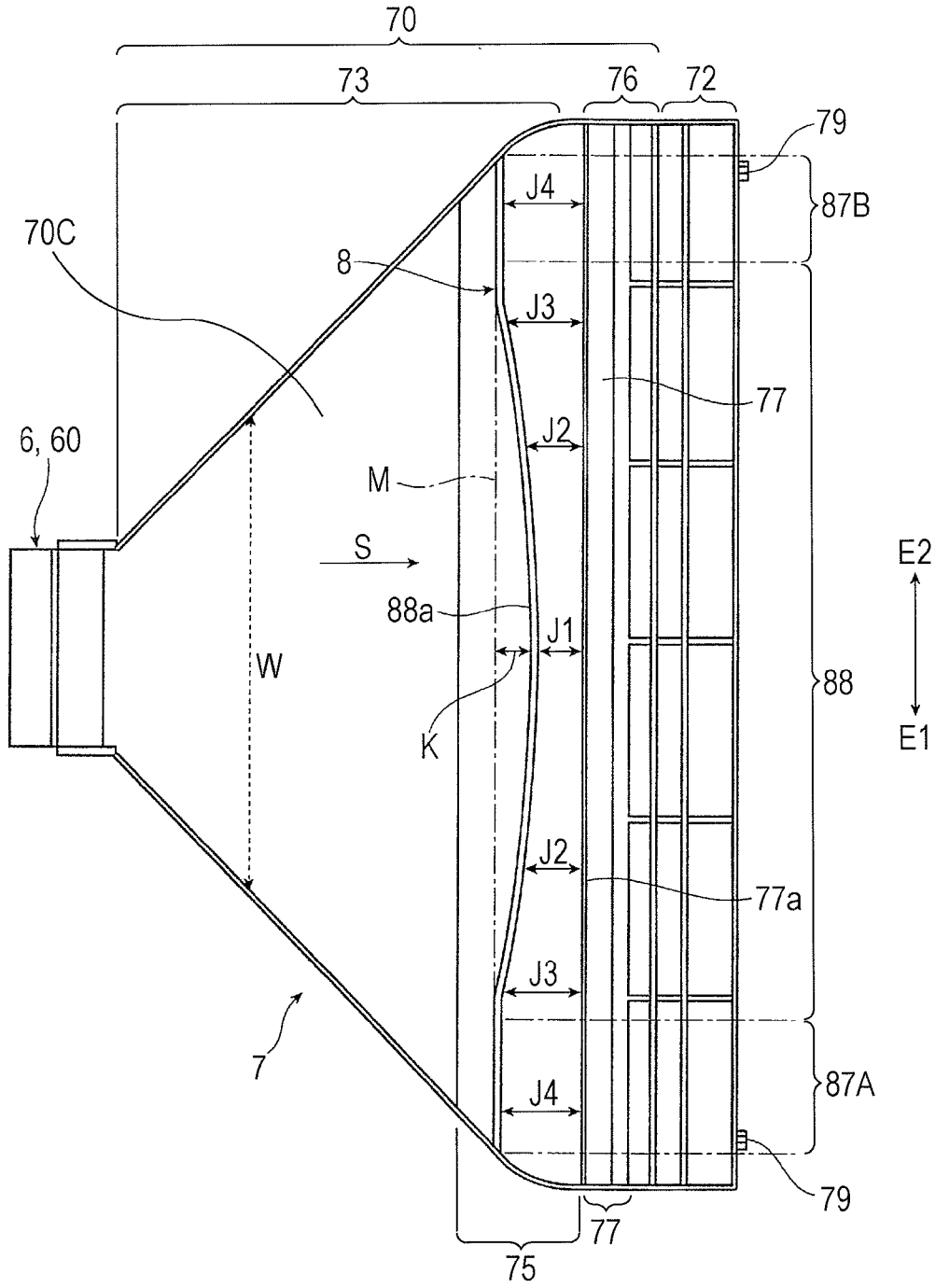
FIG. 18 illustrates an exemplary configuration of an adjustment plate including portion in which the distance from an opening in a bent portion varies.

Referring to FIG. 18, the adjustment plate 8, which is disposed in the air duct 7 of the blower 5, may have a portion in which the separation distance J from the opening 77 in the bent portion 76 varies with respect to the air flow direction S.

The adjustment plate 8 illustrated in FIG. 18 includes flat panel portions 87A and 87B and a curved panel portion 88. The flat panel portions 87A and 87B are disposed at ends of the adjustment plate 8 in the direction E along the passage width W. The curved panel portion 88 is disposed between the flat panel portions 87A and 87B and is curved toward the opening 77. The separation distance J4 between each of the flat panel portions 87A and 87B and the opening (a long edge 77*a* near the adjustment plate, see FIG. 7 etc.) is constant. The distance between the curved panel portion 88 and the opening 77 has the smallest value J1 at the center 88*a* of the curved panel portion 88 along the passage width W. As the position in the curved panel portion becomes farther from the center 88*a*, the distance gradually increases to J2 and J3 (J2<J3). The center 88*a* of the curved panel portion 88 is closer to (protrudes toward) the opening 77 than the flat panel portions 87A and 87B by a distance K (that is, for example, about 10 mm). When such an adjustment plate is used, the air is blown onto the discharge wires 231 and 232 of the corona discharger 23K with a more substantially and appropriately uniform speed.

Figure 19A:
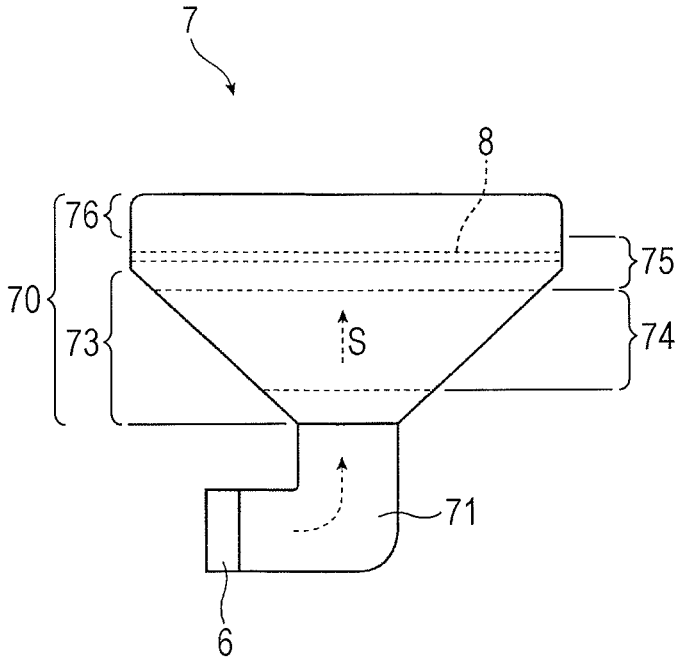
FIGS. 19A and 19B illustrates exemplary configurations of an air duct.
Figure 19B:
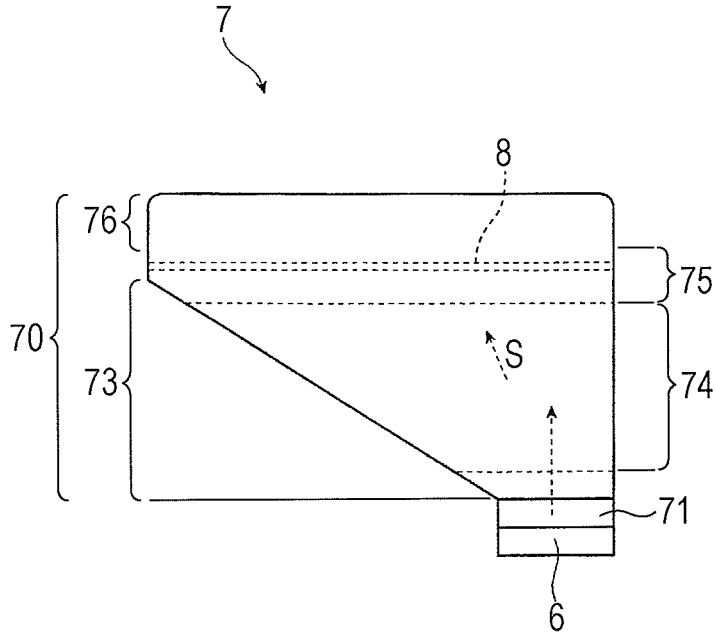

Referring to FIG. 19A, for example, in the air duct 7 of the blower 5, the fan connecting portion 71, which is connected to the increasing-width portion 73 of the body portion 70, need not be a linear duct and may be curved in a required direction. Referring to FIG. 19B, for example, the increasing-width portion 73 of the air duct 7 need have a shape such that the passage width W increases symmetrically toward both sides with respect to the air flow direction S in plan view. For example, the increasing-width portion 73 may have a shape such that the passage width W increases toward one side with respect to the air flow direction S. In the above description, the end portion of the increasing-width portion 73 of the passage of the air duct 7 extends beyond the downstream end 74*b* of the decreasing-height portion 74 to the extension portion 75. However, the end portion of the increasing-width portion 73 may be terminated at the downstream end 74*b* of the decreasing-height portion 74. The decreasing-height portion 74 need not included in the increasing-width portion 73. Alternatively, a part of the decreasing-height portion 74 may be included in the increasing-width portion 73, and the remaining part may exist outside the increasing-width portion 73.

The fan 6 of the blower 5 is not limited to an axial fan that blows air in a swirling state. Fans of different types, including a sirocco fan (multiple-blade fan) in which air flows in a direction perpendicular to the axis and a radial flow (centrifugal) fan such as a turbo fan, may be used.

The corona, discharger to which the blower 5 is applied may include only one discharge wire and need not include a grid electrode, a cleaning device, or the like. The corona discharger need not be used for charging the photoconductor drum 22, and may be used for other purposes. In a corona discharger including only one discharge wire, the blower 5 is capable of blowing air toward the one discharge wire more uniformly with respect to the direction in which the wire is stretched than in the case where the corona discharger includes two discharging wires.

In the first exemplary embodiment, the image forming device 20 includes four image forming sections (image forming units) 21. However, the image forming device 20 may include a different number of image forming sections, or may include only one image forming section. Alternatively, the image forming device 20 need not include the intermediate transfer section 31.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A blower comprising:

a fan that blows air; and an air duct having a passage formed therein, the air duct guiding the air blown by the fan to a corona discharger and blowing the air onto the corona discharger, the corona discharger including a discharge wire stretched therein, the air duct including an increasing-width portion in which a passage width gradually increases downstream in an air flow direction, the passage width being a dimension of the passage along a direction in which the discharge wire is stretched, a decreasing-height portion in which a passage height gradually decreases downstream in the air flow direction, the passage height being a distance between a top and a bottom of the passage, the decreasing height portion being included in a region of the increasing-width portion or included in a region including the increasing-width portion, an extension portion extending from a downstream end of the decreasing-height portion to a position near the corona discharger, the passage height of the passage throughout the extension portion being the same as the passage height at the downstream end of the decreasing height portion, a bent portion that is bent from a downstream end of the extension portion toward the corona discharger so as to be connected to the corona discharger, an opening formed at a downstream end of the bent portion in the air flow direction, the opening having a width at least corresponding to an effective length of the discharge wire, and a plate-shaped member disposed in the passage at a position on an inner wall of any of the decreasing-height portion and the extension portion, the inner wall being on the corona discharger side, the plate-shaped member extending over the entire passage width.

2. The blower according to claim 1, wherein the plate-shaped member is disposed in a middle portion of the extension portion with respect to the air flow direction.

3. The blower according to claim 1, wherein the plate-shaped member has a shape such that a height from the inner wall is not constant along the passage width.

4. The blower according to claim 1, wherein the plate-shaped member has low portions at both ends thereof along the passage width, the low portions each having a height above the inner wall lower than a height of a portion of the plate-shape member corresponding to a center of the passage width.

5. The blower according to claim 1, wherein the plate-shaped member includes a portion in which a distance from an opening in the bent portion in the air flow direction varies.

6. The blower according to claim 1, wherein the corona discharger includes a plurality of the discharge wires that are stretched parallel to each other with a distance therebetween, and wherein an opening in the bent portion of the air duct is located at a position such that the air is blown onto the parallel discharge wires of the corona discharger.

7. An image forming apparatus comprising:

a corona discharger including a discharge wire that is stretched; and a blower that blows air onto the corona discharger, wherein the blower is the blower according to claim 1.

8. The image forming apparatus according to claim 7, wherein the corona discharger includes a plurality of the discharge wires that are stretched parallel to each other with a distance therebetween, and wherein an opening in the bent portion of the air duct of the blower is located at a position such that air is blown onto the parallel discharge wires of the corona discharger.

* * * * *